US005982400A

United States Patent [19]

Yokoi et al.

[11] Patent Number: 5,982,400

[45] Date of Patent: Nov. 9, 1999

[54] SHEET FEEDING APPARATUS AND IMAGE FORMING SYSTEM

[75] Inventors: Katsuyuki Yokoi; Koichiro Kawaguchi, both of Yokohama, Japan

[73] Assignee: Canon Kabushiki Kaisha, Tokyo, Japan

[21] Appl. No.: 07/932,569

[22] Filed: Aug. 20, 1992

[30] Foreign Application Priority Data

| | | | |
|---|---|---|---|
| Aug. 22, 1991 | [JP] | Japan | 3-235519 |
| Sep. 13, 1991 | [JP] | Japan | 3-234695 |
| Sep. 13, 1991 | [JP] | Japan | 3-262657 |

[51] Int. Cl.[6] ..... G01D 15/24

[52] U.S. Cl. ..... 346/134

[58] Field of Search ..... 346/140 R, 134; 347/104; 271/227, 242, 243, 244, 114, 226, 109, 117, 119

[56] References Cited

U.S. PATENT DOCUMENTS

| | | | |
|---|---|---|---|
| 4,608,577 | 8/1986 | Hori . | |
| 4,723,129 | 2/1988 | Endo et al. . | |
| 4,740,796 | 4/1988 | Endo et al. . | |
| 5,240,241 | 8/1993 | Kawazoe | 271/242 X |
| 5,377,970 | 1/1995 | Kikuchi | 271/117 X |
| 5,485,991 | 1/1996 | Hirano et al. | 271/121 |

FOREIGN PATENT DOCUMENTS

| | | | |
|---|---|---|---|
| 0418515 | 3/1991 | European Pat. Off. . | |
| 54-56847 | 5/1979 | Japan . | |
| 59-108645 | 6/1984 | Japan . | |
| 59-138461 | 8/1984 | Japan . | |
| 60-71260 | 4/1985 | Japan . | |
| 60-244726 | 12/1985 | Japan | B65H 3/06 |
| 62-259944 | 11/1987 | Japan . | |
| 1-214541 | 8/1989 | Japan . | |
| 3101979 | 4/1991 | Japan . | |
| 3177247 | 8/1991 | Japan . | |

OTHER PUBLICATIONS

Grafshein, Paul and Schwarz, Otto, *Pictorial Handbook of Technical Devices*, Chemical Publishing Co., Inc., New York, 1971, pp. 6–7, 10–11.

*Primary Examiner*—N. Le
*Assistant Examiner*—Michael Nghiem
*Attorney, Agent, or Firm*—Fitzpatrick, Cella, Harper & Scinto

[57] ABSTRACT

A sheet feeding apparatus comprising first feeding device for feeding a sheet, second feeding device disposed at a downstream side of the first feeding device and adapted to pinch and feed the sheet, control device for controlling so as to drive the first and second feeding devices to feed the sheet in a predetermined direction until a leading end of the sheet passes through a nip of the second feeding device and exceeds the nip by a predetermined distance toward a downstream side while the sheet is being urged against the first feeding device, and urging device for urging the sheet against the first feeding device in such a manner that the sheet returned in the reverse direction by the second feeding device is slipped with respect to the first feeding device without flexing the sheet.

13 Claims, 23 Drawing Sheets

SHEET FEEDING APPARATUS AND IMAGE FORMING SYSTEM

BACKGROUND OF THE INVENTION

1. Field of the Invention

The present invention relates to a sheet feeding apparatus for feeding a sheet (normal sheet, cut sheet, print sheet, transfer sheet, photosensitive sheet, electrostatic recording sheet, printing sheet, OHP sheet, envelope, post card, original and the like), with preventing of the skew feed of the sheet, to a sheet processing station such as a printing station, image forming station, exposure station, working station and the like in an image forming system and other various sheet using devices such as a recording system (printer), copying machine, facsimile and the like as an information output equipment such as a word processor, computer and the like.

2. Related Background Art

In the past, various device for feeding a sheet, with preventing the skew feed of the sheet, to a sheet processing station such as a printing station of a recording system have been proposed. In an exemplary sheet feeding device, the skew feed of the sheet is prevented by utilizing flexion reactive force of the sheet. That is to say, the sheet feeding means-comprises a first sheet feeding means for feeding a sheet to a sheet processing station, and a second sheet feeding means including a pair of urgingly contacted rollers disposed between the first sheet feeding means and the sheet processing station, and is so designed that a leading end of the sheet is abutted against a nip between the paired rollers of the second sheet feeding means now stopped by the normal rotation of the first sheet feeding means, and a further normal rotation of the first sheet feeding means forms a predetermined loop in the sheet between first and second sheet feeding means in opposition to the resilience of the sheet. With this arrangement, even when the sheet is skew-fed from the first sheet feeding means, the whole length of the leading end of the sheet is abutted against the nip line between the paired rollers of the second sheet feeding means, thereby registering the leading end of the sheet with the nip line. Then, when the paired rollers of the second sheet feeding means are rotated in the normal direction, the leading end of the sheet enters into the nip of the paired rollers in parallel with the nip line, with the result that the sheet is sent to the sheet processing station without the skew feed of the sheet.

On the other hand, there are conventional feeding apparatuses wherein the first and second sheet feeding means are operated as follows.

In FIG. 27, the reference numeral 303 denotes a sheet supply roller; 304 denotes a sheet stacker; 305 denotes a recording medium; 301 denotes a convey roller; and 302 denotes a driven roller. When the sheet supply roller 303 and the convey roller 301 are rotated in the normal direction, the recording medium 305 on the sheet stacker 304 is picked up. These rollers 303, 301 are rotated normally until a leading end of the recording medium 305 has passed through a nip between the convey roller 301 and the driven roller 302. Thereafter, the sheet supply roller 303 is stopped while abutting against the sheet stacker 304, and then, the convey roller 301 is rotated reversely, thereby returning the leading end of the recording medium 305 to a position upstream of the nip between the convey roller 301 and the driven roller 302 (FIGS. 28 and 29). In this condition, since a trailing end of the recording sheet 305 is pinched between the sheet supply roller 303 and the sheet stacker 304 urged against the sheet supply roller which are now stationary, the recording medium is flexed or bent between the sheet supply roller 303 and the convey roller 301 by an amount corresponding to the returning distance of the leading end of the recording medium, with the result that the leading end of the recording medium is wholly abutted against the nip line between the convey roller 301 and the driven roller 302. Thereafter, by rotating the convey roller 301 and the sheet supply roller 303 normally by a predetermined amount, the recording medium is fed to a printing position.

However, in the above-mentioned sheet feeding apparatus and its control, the leading end of the recording medium is returned toward the upstream side from the nip between the convey roller 301 and the driven roller 302, and then, is abutted against the nip, thereby preventing the skew feed of the recording medium. Thus, although the skew feed preventing ability is highly ensured in case of the cut sheet and the like a thickness of which is uniformly controlled, regarding sheets having no uniform thickness such as envelopes folded several times over and having different thickness folded portions, as shown in FIG. 30, when the leading end of the sheet is returned toward the upstream side from the nip between the convey roller 301 and the driven roller 302 and then is abutted against the nip, since positions on the leading end of the sheet are different from point to point along a line perpendicular to a plane of FIG. 30, this feeding method causes the skew feed of the sheet more noticeably than the case where the sheet is directly forwarded without returning it toward the upstream side. Further, regarding sheets having the greater thickness and high resilience, when the convey roller is rotated reversely to return the sheet toward the upstream side from the nip between the convey roller 301 and the driven roller 302, because of the high resilience of the sheet, the loop cannot be formed in the sheet between the convey roller and the sheet supply roller, but the convey roller is slipped without returning the sheet, with the result that, when the convey roller is then rotated normally by the predetermined amount to send the sheet to the print start position, the sheet will be fed excessively.

Further, in the conventional sheet feeding apparatus having the above-mentioned skew feed preventing ability, a greater space is required between the first and second sheet feeding means for permitting the formation of the predetermined loop in the sheet, because if such a space is small the sheet will be bent or folded. As a result, it was hard to make the apparatus small-sized.

Further, in a recording system of serial type wherein the main scan is effected along a direction transverse to a recording sheet feeding direction (sub scanning direction), after the recording sheet is set at a predetermined recording position, an image segment is recorded on the sheet (main scan) by a recording means (recording head) mounted on a carriage shifted along the recording sheet until the one-line recording is completed. Thereafter, the sheet is line-spaced by a predetermined amount (sub scan) and then an image segment for the next line is recorded on the recording sheet (main scan). By repeating these operations, the total image is recorded on the whole area of the recording sheet. On the other hand, in a recording system of line type wherein the recording is effected by utilizing only the sub scan for feeding a recording sheet in a sheet feeding direction, after the recording sheet is set at a predetermined recording position, an image segment for one line is recorded on the sheet en bloc. Thereafter, the sheet is advanced by a predetermined amount (pitch-feed) and then an image segment for the next line is recorded on the recording sheet en bloc. By repeating these operations, the total image is recorded on the whole area of the recording sheet.

Among these recording systems, an ink jet recording system is designed so that the recording is effected by discharging ink from a recording means (recording head) toward a recording sheet, and has advantages that the recording means can easily be made compact, an image having the high resolving power can be recorded at a high speed, the image can be recorded on a plain paper without the special treatment, the running cost is cheap, the noise can be reduced because of non-impact recording type, and a color image can easily be obtained by using plural color inks.

In particular, the ink jet recording means (recording head) for discharging the ink by utilizing thermal energy can easily be manufactured with a high dense liquid passages arrangement (discharge openings arrangement) through semiconductor manufacturing processes such as etching, depositing, spattering and the like, thus making the recording means more compact.

The feeding mechanism (sub scanning mechanism) for the recording sheet in the above-mentioned recording systems comprises a first convey roller disposed at an upstream side of the recording head in the sheet feeding direction and a second convey roller disposed at a downstream side of the recording head in the sheet feeding direction, and is so designed that these rollers are driven synchronously with each other by a single convey motor (sub scanning motor) via a gear train. Incidentally, to establish a feeding force, each convey roller is associated with a driven roller which can be urged against the associated convey roller. Further, in order to prevent the slack of the recording sheet at the recording position, a gear ratio of the gear train is selected so that a peripheral speed of the second convey roller is greater than that of the first convey roller by a few percents or is at least equal to the peripheral speed of the first convey roller, and the feeding force obtained from the urging engagement between the second convey roller and the associated driven roller is selected to be smaller than that obtained from the urging engagement between the first convey roller and the associated driven roller. Further, in the above-mentioned gear train, the backlash is provided between gear shafts to prevent the increase in the rotational load due to the gear encroachment. Such backlash is provided between the adjacent two of all of the gear shafts.

In the feeding mechanism for the recording sheet in the above-mentioned recording systems, when a trailing end of the recording sheet is situated at an upstream side of a nip between the first convey roller and the associated driven roller in the sheet feeding direction, due to the fact that the peripheral speed of the second convey roller is greater than that of the first convey roller and the fact that the feeding force of the second convey roller is smaller than that of the first convey roller, the second convey roller is always subjected to a tension force directing toward the upstream side in the sheet feeding direction. Consequently, the driving amount of the convey motor is accurately transmitted to the second convey roller without being influenced upon the backlashes between the gear shafts, and the sheet feeding amount (sub scanning amount) itself is controlled or governed by the first convey roller, thereby performing the accurate feeding of the recording sheet (sub scan).

However, when the trailing end of the recording sheet leaves the nip between the first convey roller and the associated driven roller, the tension force acting on the second convey roller to pull the latter toward the upstream side in the sheet feeding direction is temporarily disappeared, with the result that the second convey roller is influenced upon the backlashes between the gear shafts due to the rotational inertia force of the second convey roller and is rotated by an amount greater than the normal rotation angle. Consequently, the feeding of the recording sheet (sub scan) becomes inaccurate, which results in a white blank in the recorded image, thus deteriorating the image quality. The faster the feeding speed to improve the through-put, the more this tendency is noticeable.

SUMMARY OF THE INVENTION

An object of the present invention is to eliminate the above-mentioned conventional drawbacks obstructing the compactness of a sheet feeding apparatus by permitting the feeding of a sheet with preventing the skew feed of the sheet and without requiring a space for the formation of a loop in the sheet between first and second sheet feeding means.

The present invention relates to a sheet feeding apparatus comprising first sheet feeding means for feeding a sheet to a sheet processing station, second sheet feeding means disposed between the first sheet feeding means and the sheet processing station and including a pair of rollers urged against each other, drive and drive transmitting means for the first and second sheet feeding means, and control means for controlling the drive and drive transmitting means.

The control means controls the drive and drive transmitting means for the first and second sheet feeding means in such a manner that the first and second sheet feeding means are rotated normally to feed the sheet from the first sheet feeding means to the second sheet feeding means until a leading end of the sheet exceeds a nip between the paired rollers of the second sheet feeding means by a predetermined distance L, then, the drive transmission to the first sheet feeding means is stopped and the second sheet feeding means is rotated reversely to feed the sheet reversely until the sheet is returned more than the predetermined distance L, and then the paired rollers of the second sheet feeding means are rotated normally again to enter the sheet into the nip again and to further feed the sheet normally toward the sheet processing station. A sheet holding or urging force of the first sheet feeding means which is stopped when the sheet is fed reversely is so selected that the sheet fed reversely by the second sheet feeding means can be slipped with respect to the first sheet feeding means not to flex the sheet between the first and second sheet feeding means.

Further, another object of the present invention is to provide a recording system which permits the good sub scan through the whole recording area without adding additional parts and without sacrificing the through-put.

The present invention prevents the influence of the backlash between the gears by controlling the sub scan so that the feeding speed becomes slower than the normal feeding speed within a predetermined range before and after the trailing end of the sheet passes through the nip between a first convey roller and its associated driven roller, thereby feeding the recording sheet accurately.

The present invention achieves the above-mentioned object by providing a recording system comprising recording means for recording an image on a recording sheet in response to image information, a first convey roller disposed at an upstream side of a recording position in a sheet feeding direction, and a second convey roller disposed at a downstream side of the recording position in the sheet feeding direction. Wherein a feeding speed of the first convey roller is slower than the normal feeding speed within a predetermined range before and after a trailing end of the sheet passes through the first convey roller. Further, according to another aspect of the present invention, the above object is achieved more effectively by driving the first and second convery rollers by a single common motor or by increasing a feeding speed of the second convey roller more than that of the first convey roller, in addition to the above-mentioned arrangement.

BRIEF DESCRIPTION OF THE DRAWINGS

FIG. 5 illustrates a sheet supply waiting condition, FIG. 6 illustrates an initial condition of the sheet supplying operation, FIGS. 7–9 illustrate intermediate conditions during the sheet supplying operation, FIG. 10 illustrates a condition that the sheet is fed reversely, and FIG. 11 illustrates a condition that the sheet is fed normally again;

DETAILED DESCRIPTION OF THE PREFERRED EMBODIMENTS

First of all, a general construction of a recording system will be explained.

Figure 1:
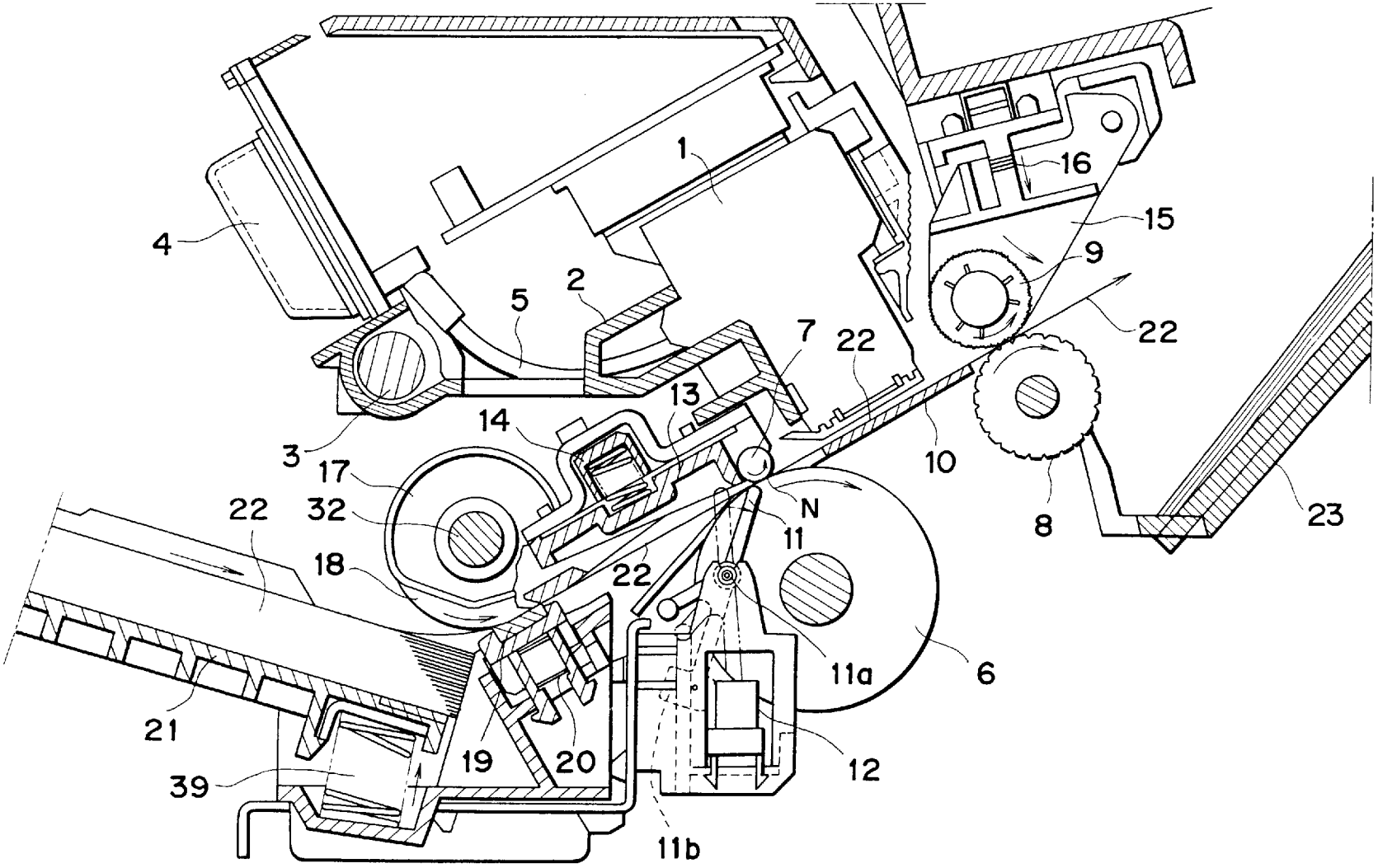
FIG. 1 is a schematic sectional view of a main portion of a recording system of serial type into which a sheet feeding apparatus according to the present invention is incorporated.

FIG. 1 is a schematic elevational sectional view of a main portion of a recording system into which a sheet feeding apparatus according to the present invention is incorporated.

An ink jet recording head 1 is mounted on a carriage 2. When the carriage 2 is shifted in a main scanning direction perpendicular to a plane of FIG. 1 along a carriage shaft 3, the recording head 1 is moved for the main scan. An ink tank 4 serves to reserve ink which is supplied to the recording head 1 via an ink pipe 5.

A paper guide (platen plate) 10 serves to define a position (printing station or sheet processing station) wherein an image is printed or recorded on a recording sheet by the recording head 1. The recording head 1 is disposed in confronting relation to the paper guide 10 with a small gap therebetween and is moved along a surface of the paper guide 10. A sheet stacker 21 is arranged in an inclined relation so that it is inclined downwardly and forwardly. The sheet stacker is normally biased upwardly by a spring 39. Recording sheets 22 are rested and stacked on the sheet stacker 21.

A semi-circular sheet supply roller (first sheet feeding means) 17 is fixedly mounted on a sheet supply roller shaft 32. Idle rollers 18 (see FIG. 13) are disposed on both sides of the sheet supply roller 17 and are idly mounted on the sheet supply roller shaft 32. Diameters of the idle rollers 18 are smaller than a diameter of the sheet supply roller 17. A friction member (friction pad) 19 is disposed below the sheet supply roller 17 and is always biased upwardly by a spring 20 so that it is urged against the idle rollers 18 or a cylindrical portion of the semi-circular sheet supply roller 17.

A pair of rollers 6, 7 which are urged against each other constitute a second sheet feeding means. The lower large roller 6 acts as a driving roller (referred to as "convey roller" hereinafter) and the upper small roller 7 acts as a driven roller. The upper driven roller 7 is held by a holder member 13 which is biased toward the lower convey roller 6 by a spring 14 so that the driven roller 7 is urged against the convey roller 6.

A pair of ejector rollers comprise a lower driving roller 8 and an upper driven roller 9. The upper driven roller 9 is held by a holder member 15 which is biased toward the lower driving roller 8 by a spring 16 so that the upper driven roller 9 is urged against the lower driving roller 8. Incidentally, the reference numeral 23 denotes an ejection sheet stacker.

A sensor lever 11 and a photosensor 12 are disposed at a downstream side of a nip N between the paired rollers (second sheet feeding means) 6, 7 to detect a leading end and a trailing end of the recording sheet.

Next, a drive and drive transmitting mechanism will be explained with reference to FIGS. 2 to 4.

Figure 2:
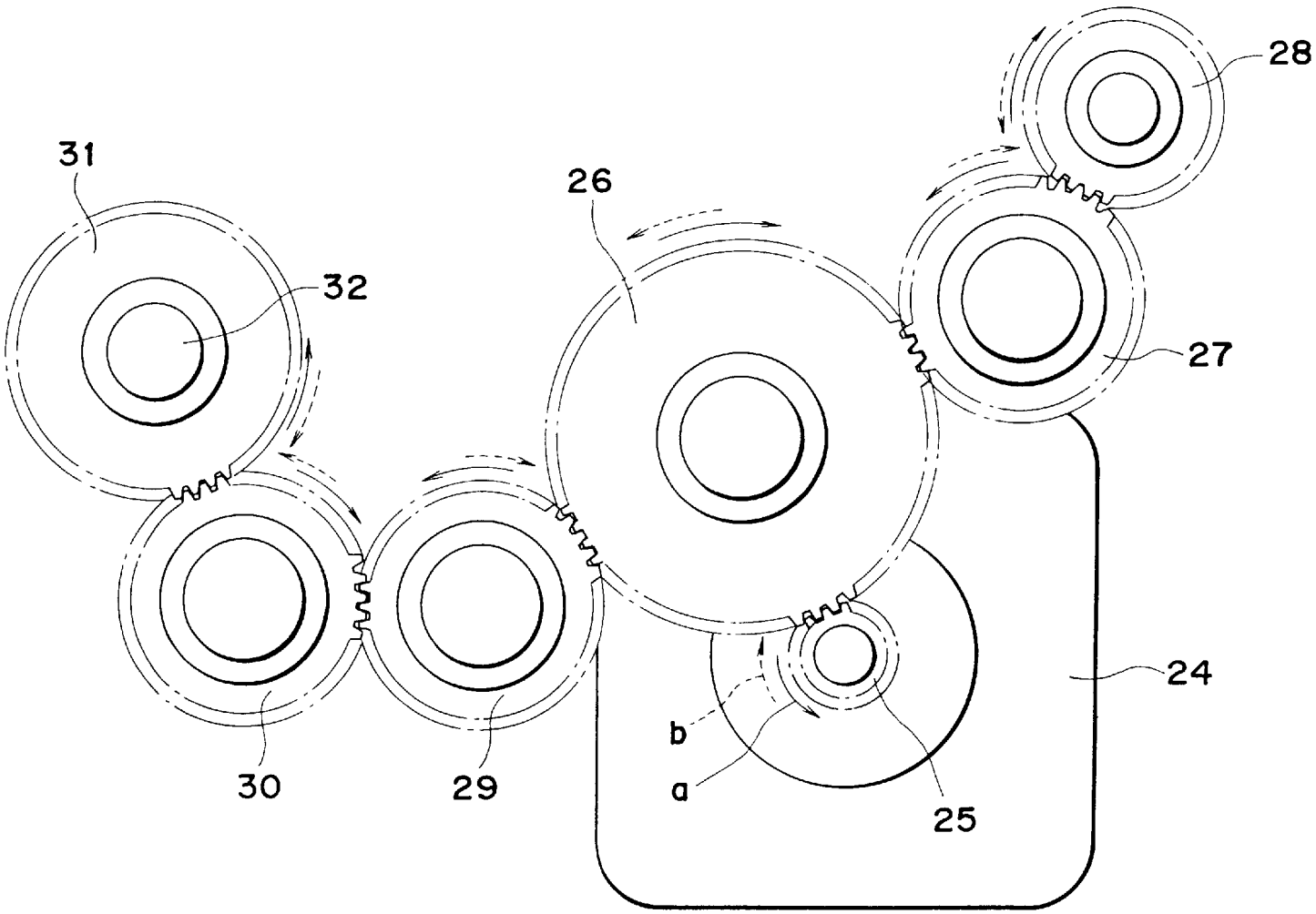
FIG. 2 is a view showing a gear train of a drive mechanism.

FIG. 2 shows a gear train of a drive mechanism. In FIG. 2, the reference numeral 24 denotes a pulse motor (sub scan drive motor) as a drive source; 25 denotes a motor gear secured to an output shaft of the pulse motor; 26 denotes a convey roller gear secured to a roller shaft of the convey roller 6 of the paired rollers (second sheet feeding means) 6, 7; 31 denotes a sheet supply roller gear (clutch gear) idly mounted on the roller shaft 32 of the sheet supply roller (first sheet feeding means) 17; and 28 denotes an ejector roller gear secured to a roller shaft of the driving roller 8 of the paired ejector rollers 8, 9. The motor gear 25 is meshed with the convey roller gear 26 which is in turn drivingly connected to the sheet supply roller gear 31 via idle gears 29, 30 and which is also drivingly connected to the ejector roller gear 28 via an idle gear 27.

Accordingly, when the motor gear 25 is rotated normally in a direction shown by the arrow a by the normal rotation of the motor 24, the convey roller gear 26, sheet supply roller gear 31 and ejector roller gear 28 are also rotated in normal directions. As a result, the sheet supply roller 17 is rotated in a normal direction (sub scanning direction) to feed out the recording sheet when a spring clutch 40 (described later) is in a clutch-ON condition. Further, the convey roller 6 and the ejector roller 8 are also rotated in normal rotational directions to advance the recording sheet.

Figure 3:
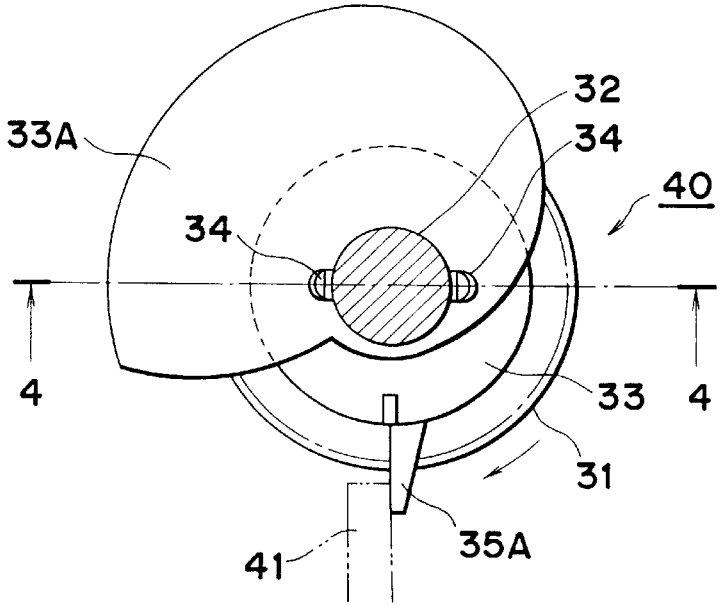
FIG. 3 is a side view showing a spring clutch.
Figure 4:
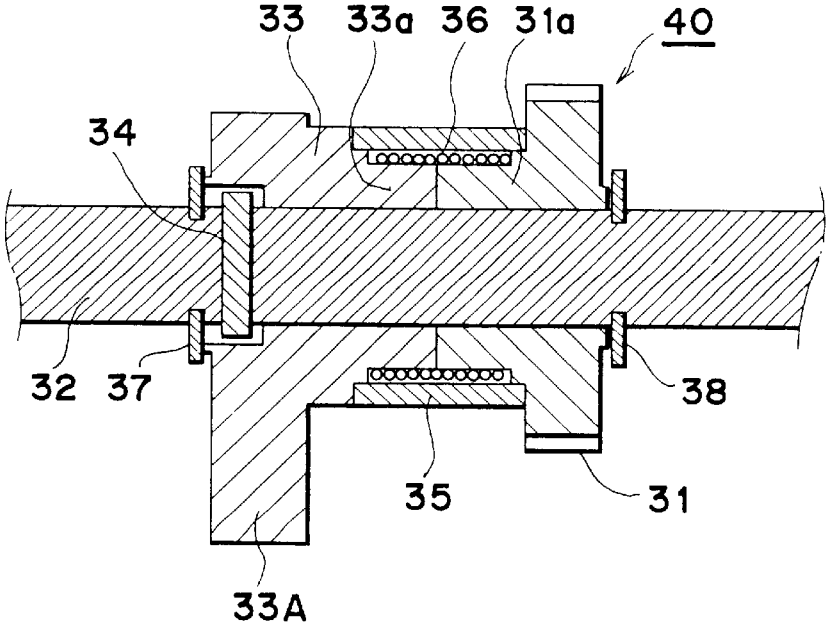
FIG. 4 is a sectional view taken along the line 4—4 in FIG. 3.
Figure 5:
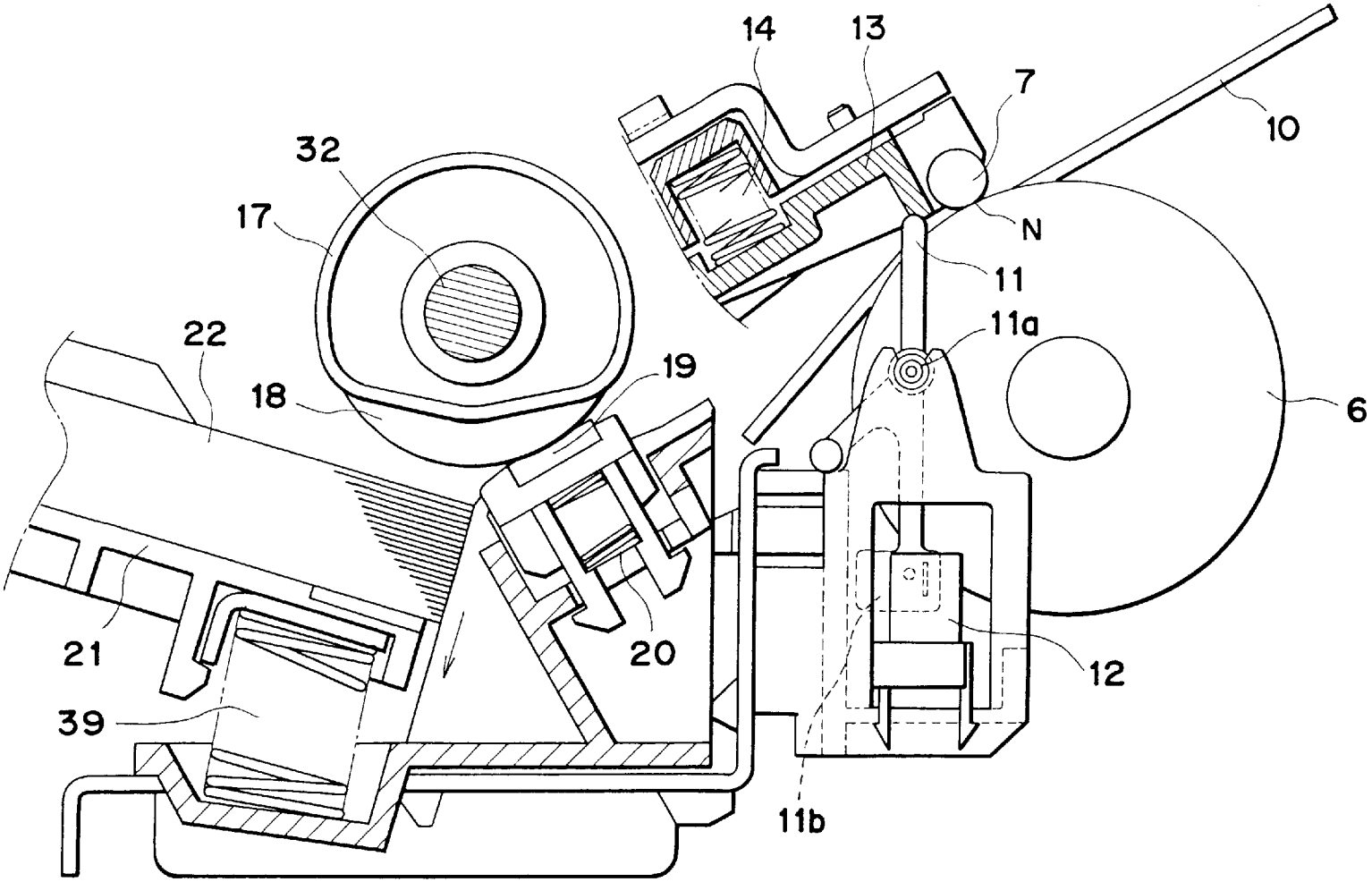
FIGS. 5 to 11 are elevational sectional views for explaining a sheet supplying operation, where

FIG. 3 is a side view of the spring clutch 40 provided on the sheet supply roller shaft 32, and FIG. 4 is a sectional view taken along the line 4—4 in FIG. 3. In FIG. 3, the sheet supply roller gear 31 is idly mounted on the sheet supply roller gear 32 as mentioned above. A clutch drum 33 is disposed in confronting relation to the sheet supply roller gear 31 and is also mounted on the sheet supply roller shaft 32, which clutch drum 33 is prevented from rotating with respect to the sheet supply roller shaft 32 by an idle rotation preventing pin 34. A cam portion 33A is integrally formed with the clutch drum 33. The clutch drum 33 and the sheet supply roller gear 31 are prevented from shifting in the thrust direction by stopper members 37, 38, respectively.

A coil clutch spring 36 is arranged around both a hub 33*a* of the clutch drum 33 and a hub 31*a* of the sheet supply roller gear 31, and a control ring 35 is arranged around the clutch spring 36. One end (near the clutch drum 33) of the clutch spring 36 is attached to the clutch drum 33 and the other end (near the sheet supply roller gear 31) of the clutch spring is attached to the control ring 35. A lock lever 35A is secured to the control ring 35 and can be locked by a stopper 41 which can be pivoted by an electromagnetic solenoid (not shown).

In a clutch-OFF condition, the lock lever 35A of the control ring 35 is held by the stopper 41, thus preventing the rotation of the control ring 35. Consequently, the clutch spring 36 is held in a relaxed condition on the hub 31*a* of the sheet supply roller gear 31, whereby the sheet supply roller gear 31 can be idly rotated on the shaft 32, with the result that the rotation force of the gear 31 is not transmitted to the shaft 32. Thus, even when the gear 31 is rotatingly driven, the sheet supply roller 17 remains in a stopped condition.

When the clutch is turned ON, the stopper 41 is disengaged from the lock lever 35A of the control ring 35, thus releasing the control ring 35. As a result, the clutch spring 36 is tightened around the hub 31*a* of the sheet supply roller gear 31 to the clutch drum 33 via the clutch spring 36, thereby transmitting the rotational force of the gear 31 to the shaft 32 to rotate the latter along with the gear 31. That is to say, the sheet supply roller 17 is rotated.

Next, the control and operation will be explained with reference to FIGS. 5 to 11, FIG. 12 and FIGS. 13 to 16.

Figure 6:
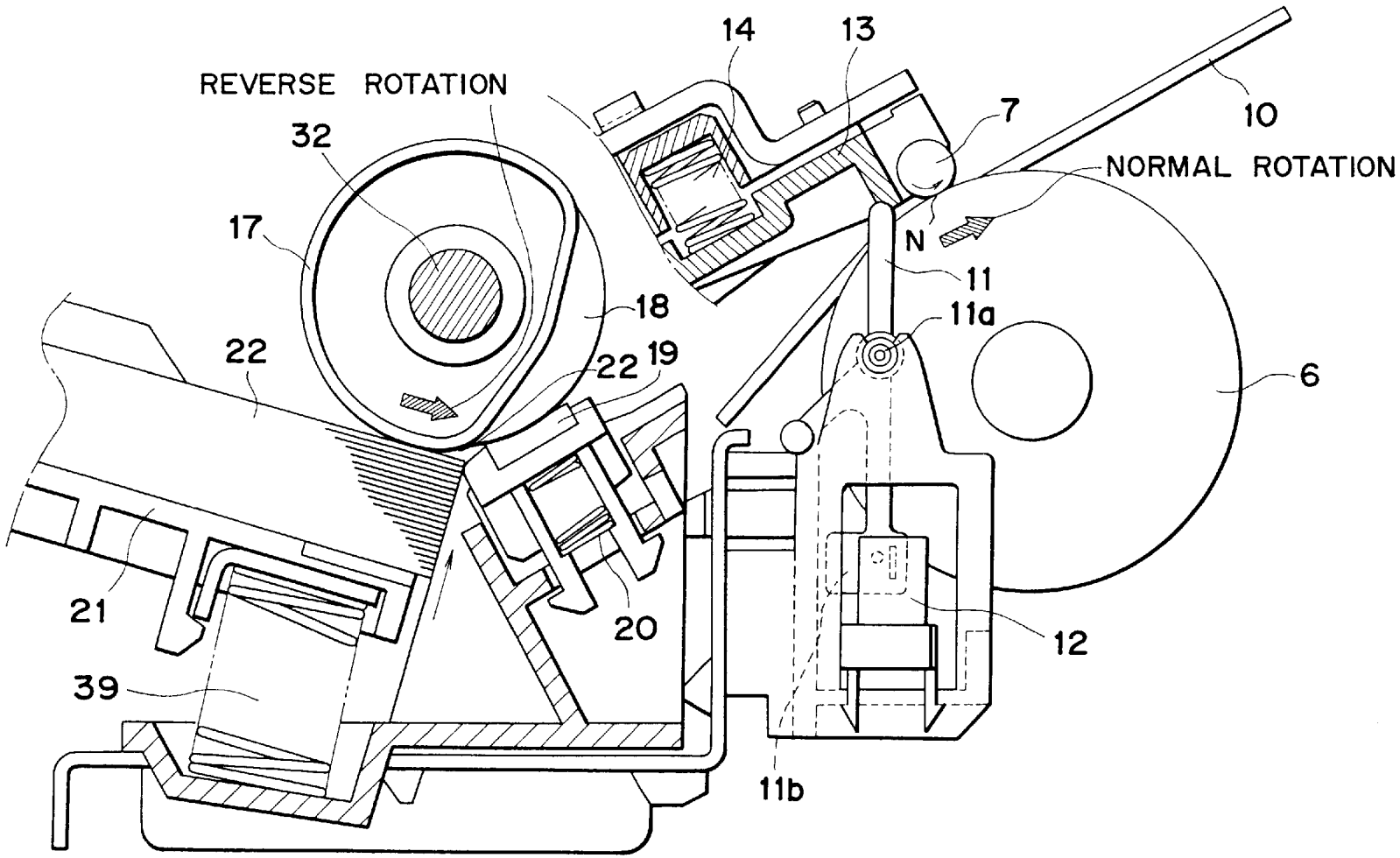

(a) FIG. 6 shows a main portion of the sheet feeding apparatus in a sheet supply waiting condition.

In this sheet supply waiting condition, the motor 24 (FIG. 2) was turned OFF, and the spring clutch 40 was in the clutch-OFF condition by engaging the lock lever 35A by the stopper 41. The sheet supply roller 17 was in an angular position where a cut-out portion of the semi-circular sheet supply roller was directed downwardly and was not contacted with the friction member 19, and this friction member 19 was urged against the idle rollers 18.

Further, the sheet stacker 21 was held in a predetermined lower waiting position by the cam 33A of the clutch drum 33 of the spring clutch 40 in opposition to the biasing spring 39, where the leading upper surface of the sheet stack 22 was not contacted with both the idle rollers 18 and the sheet supply roller 17.

(b) In this sheet supply waiting condition, when a sheet supply start signal is sent to a control means (not shown), the stopper 41 is disengaged from the lever 35A of the spring clutch 40, thus turning the clutch ON. Further, the motor 24 is rotated normally (steps S1 to S3 in a flow chart in FIG. 12).

As a result, the sheet supply roller 17 starts to rotate normally, and the convey roller 6 and the ejector roller 8 also start to rotate normally. Further, the sheet stacker 21 is released from the cam 33A, thereby lifting the sheet stacker 21 by the spring 39 to urge the leading upper surface of the sheet stack 22 against the cylindrical portion of the rotating sheet supply roller 17 as shown in FIG. 6. As the sheet supply roller 17 continues to rotate normally, an uppermost sheet on the sheet stack 22 is picked up and supplied.

Figure 7:
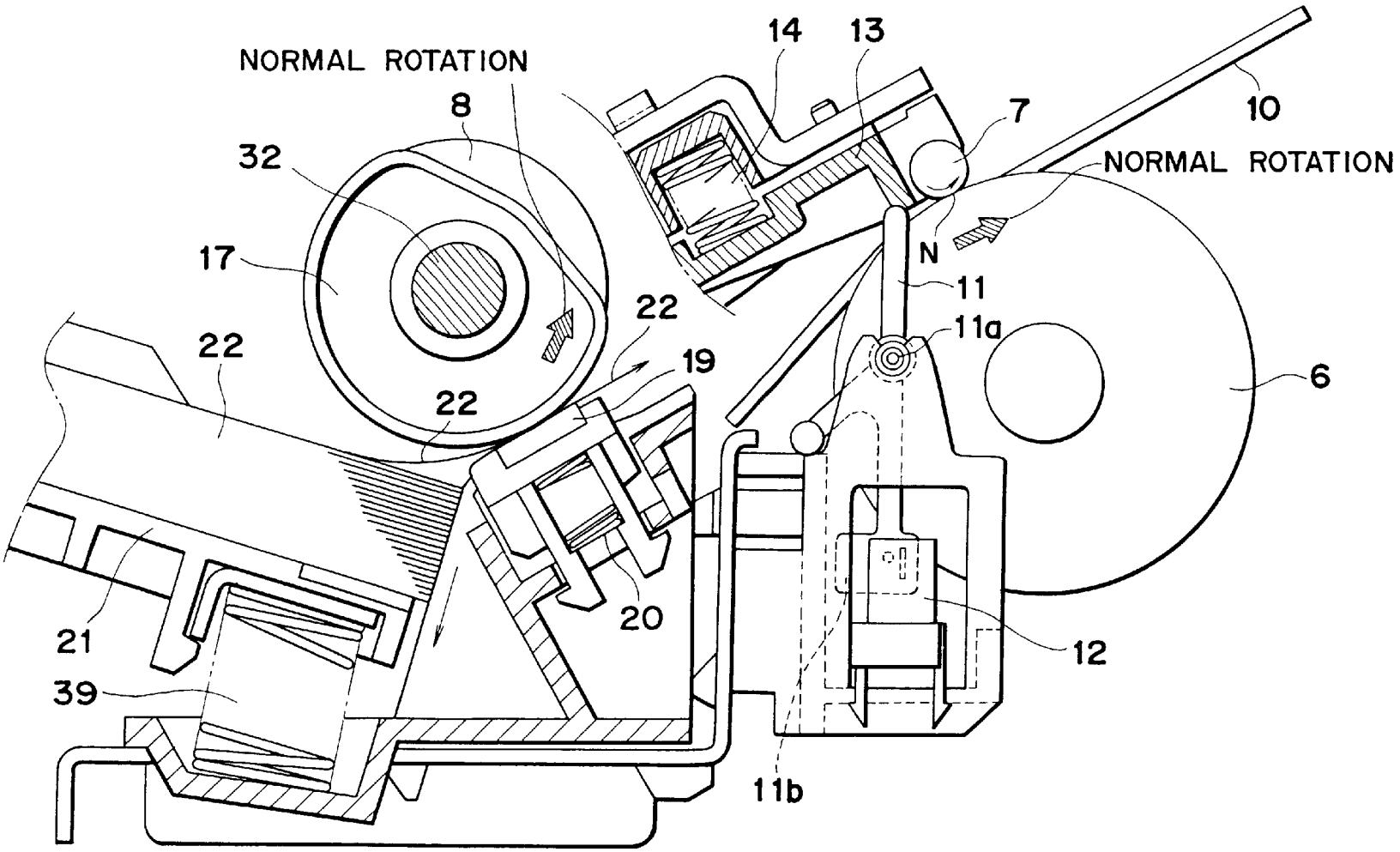

(c) The supplied sheet enters between the sheet supply roller 17 and the friction member 19. In this case, even if the second and other sheets are double-fed together with the uppermost sheet, such second and other sheets are prevented, by the friction member 19, from passing between the sheet supply roller 17 and the friction member 19, thereby separating the uppermost sheet alone from the other sheets and feeding it in the normal direction through the nip between the sheet supply roller 17 and the friction member 19 as shown in FIG. 7. After the leading end of the uppermost sheet enters into the nip between the sheet supply roller 17 and the friction member 19, the sheet stacker 21 is lowered again to the predetermined waiting position by the cam 33A of the clutch drum 33 in opposition to the spring 39, thus releasing the urging force of the spring 39 (urging the sheet stack against the sheet supply roller 17).

Figure 8:
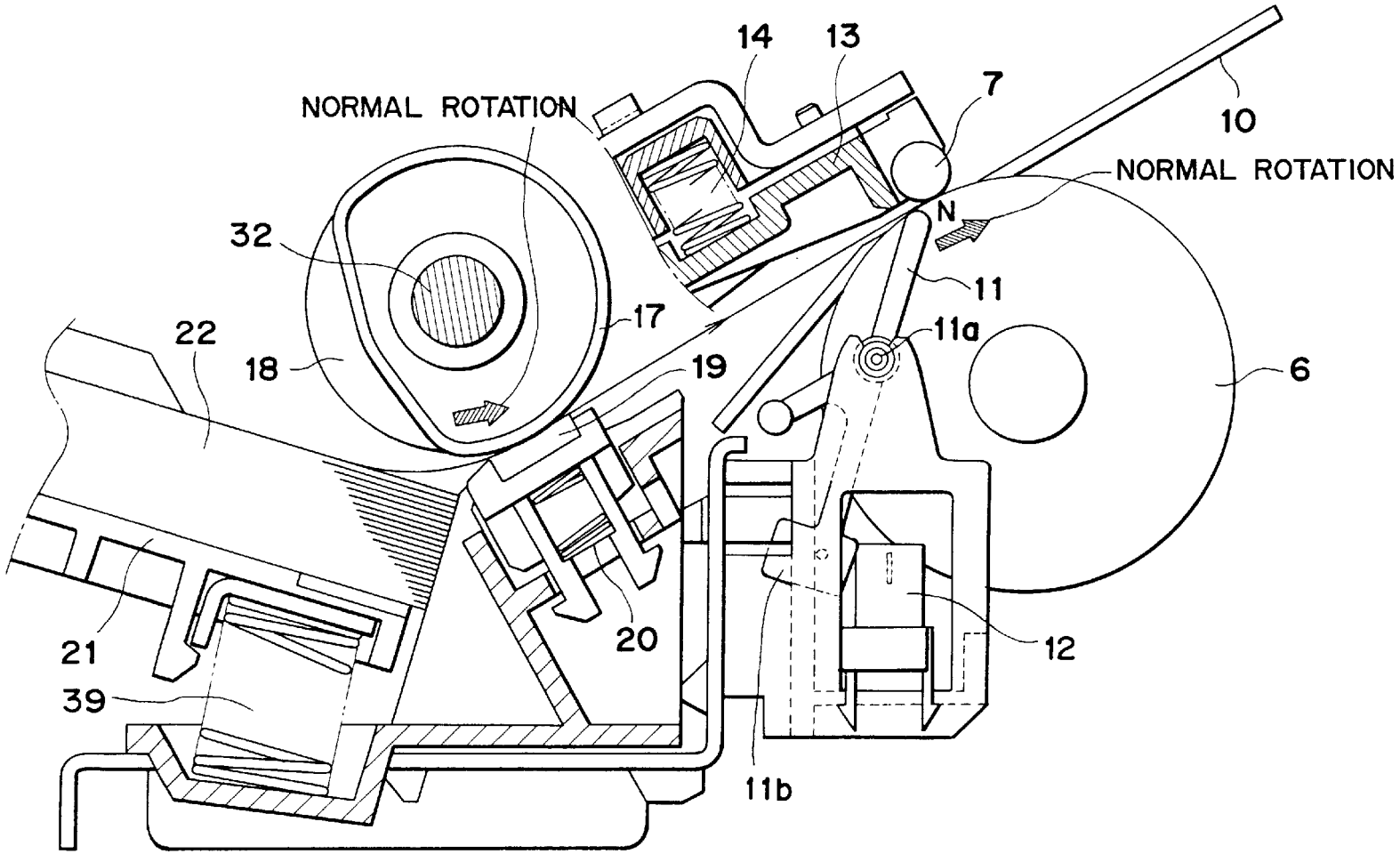

(d) The further normal rotation of the sheet supply roller 17 causes the sheet 22 to feed in the normal direction. When the leading end of the sheet reaches near the nip N between the convey roller 6 and the associated driven roller 7 (second sheet feeding means), the sensor lever 11 is moved by the leading end of the sheet to rotate this lever in a clockwise direction around a pin 11*a,* thereby shifting a light blocking flag 11*b* out of a light path of the photosensor 12 to open this light path (FIG. 8). As a result, the sensor 12 is turned ON to inform the control means of the detection of the leading end (tip end) of the recording sheet (recording material) (step S4 in the flow chart in FIG. 12). This detection signal causes a timer circuit of the control means to drive.

Figure 9:
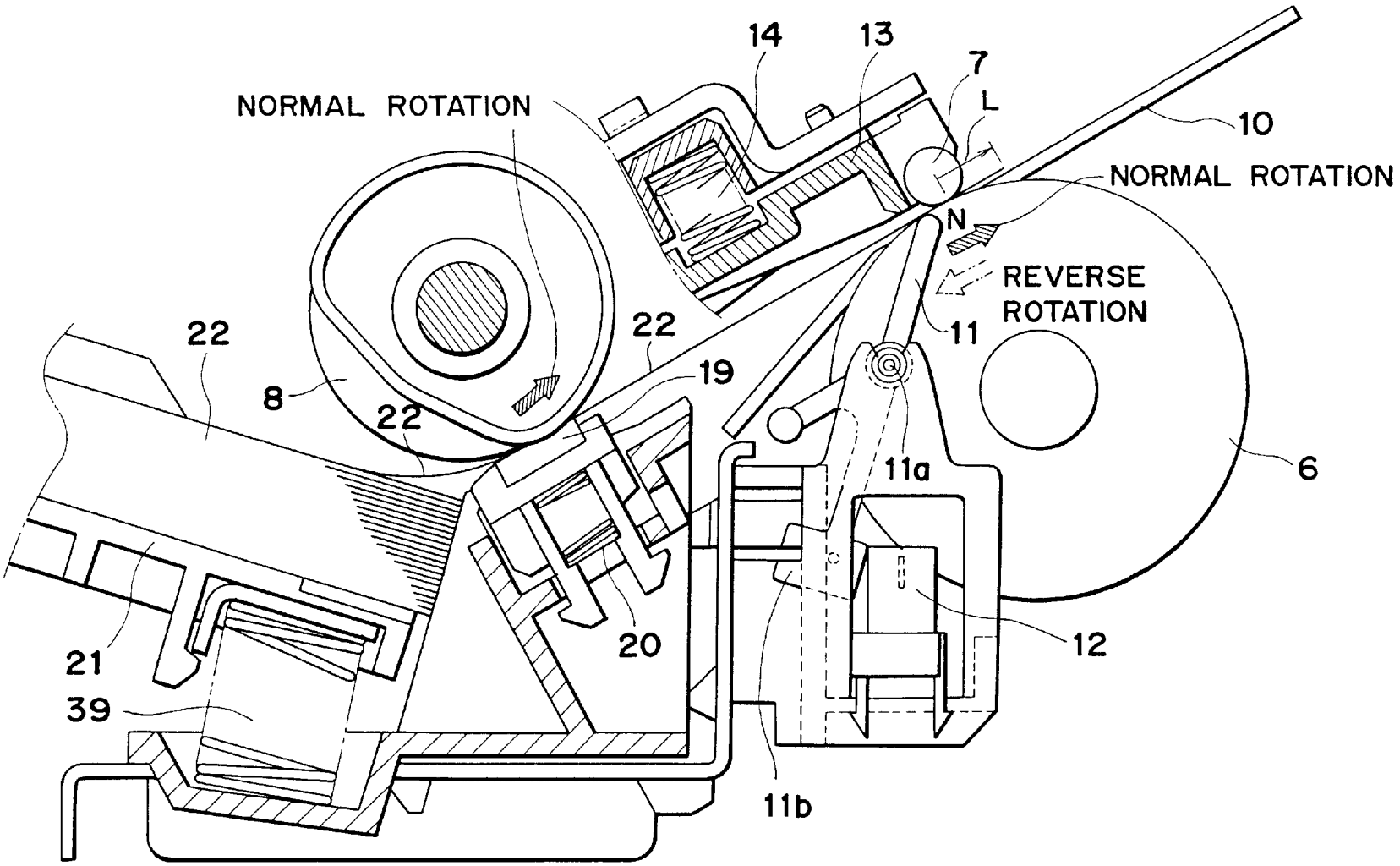
Figure 10:
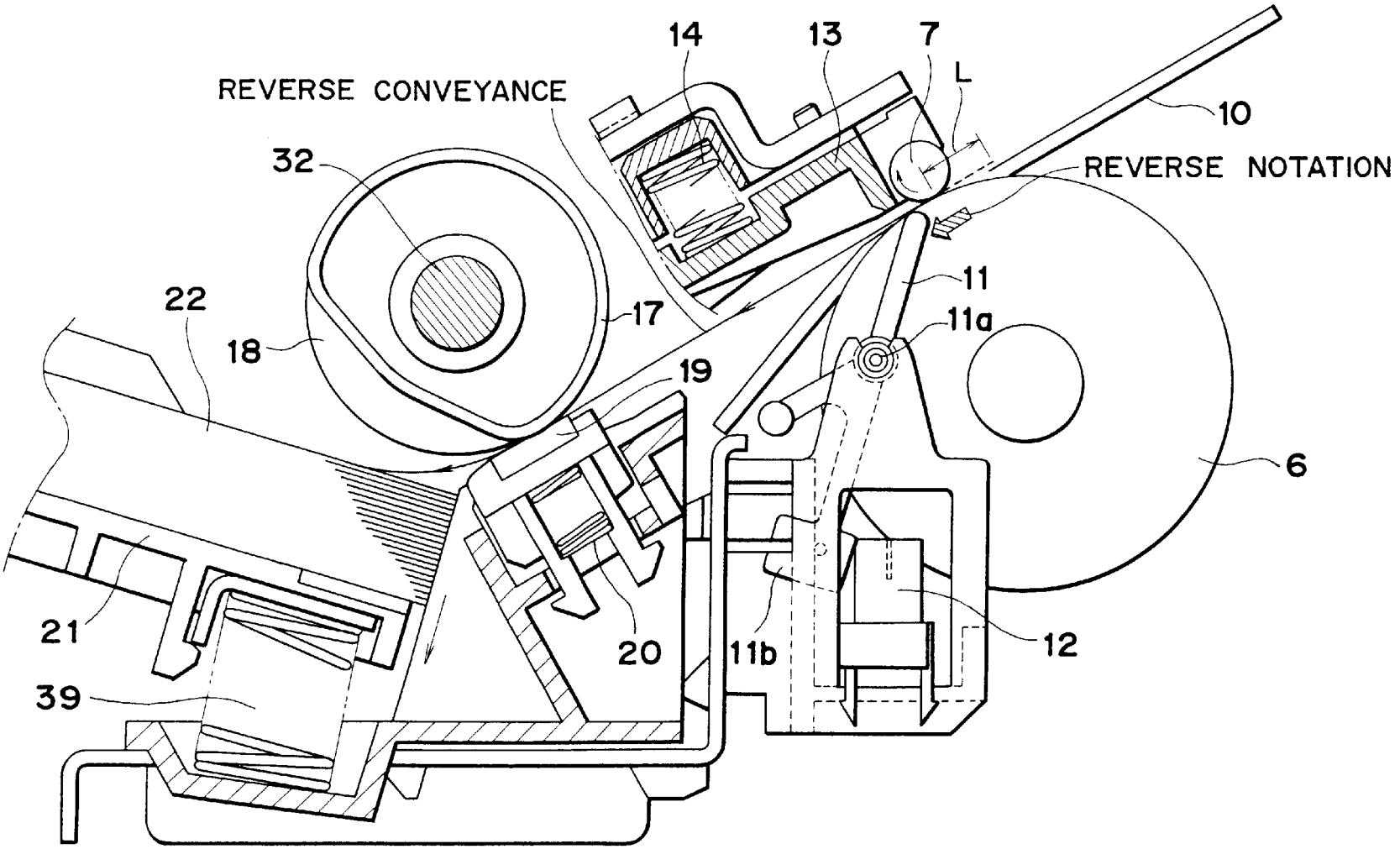

(e) The sheet is further fed in the normal direction, and the leading end of the sheet enters into the nip N between the convey roller 6 and the driven roller 7 (second sheet feeding means) now rotating the normal direction. As shown in FIG. 9, when the leading end of the sheet reaches a predetermined distance L forwardly from the nip N of the rollers 6, 7, the timer circuit is timed up. That is to say, the timer circuit is so selected to have the time duration from when the leading end of the sheet is detected by the sensor 12 to when the leading end of the sheet reaches the predetermined distance L forwardly from the nip N of the rollers 6, 7.

(f) The motor 24 (FIG. 2) is rotated reversely by a time-up signal emitted when the timer circuit is timed up. At this point, the uppermost sheet 22 extends between the first sheet feeding means (sheet supply roller 17 and friction member 19) and the second sheet feeding means (convey roller 6 and driven roller 7) being engaged by them.

When the motor 24 is rotated reversely, the convey roller gear 26, sheet supply roller gear 31 and ejector roller gear 28 are also rotated reversely, thereby rotating the convey roller 6 and the ejector roller 8 reversely. The reverse rotation of the convey roller 6 causes the sheet 22 to feed back in a reverse direction. Regarding the sheet supply roller 17, since the clutch spring 36 of the spring clutch 40 is loosened due to the reverse rotation of the sheet supply roller gear 31, the reverse rotational force of the sheet supply roller gear 31 is not transmitted to the sheet supply roller shaft 32. Accordingly, the sheet supply roller 17 is prevented from rotating by the urging force between this roller and the friction member 19, but is permitted to rotate reversely by an amount corresponding to the loosened clutch spring 36.

When the sheet 22 is fed back in the reverse direction by the convey roller 6 now rotating reversely, the sheet supply roller 17 is rotated reversely by the amount corresponding to the loosened clutch spring 36 in opposition to the friction force this roller and the sheet. Thereafter, since there is no space for permitting the flexion of the sheet between the sheet supply roller 17/friction member 19 and the convey roller 6/driven roller 7, and the friction force F2 for the sheet 22 due to the urging force between the sheet supply roller 17 and the friction member 19 is smaller than the friction force F1 for the sheet 22 due to the urging force between the convey roller 6 and the driven roller 7, the sheet 22 is shifted in the reverse direction while slipping between the sheet supply roller 17 and the friction member 19.

Figure 12:
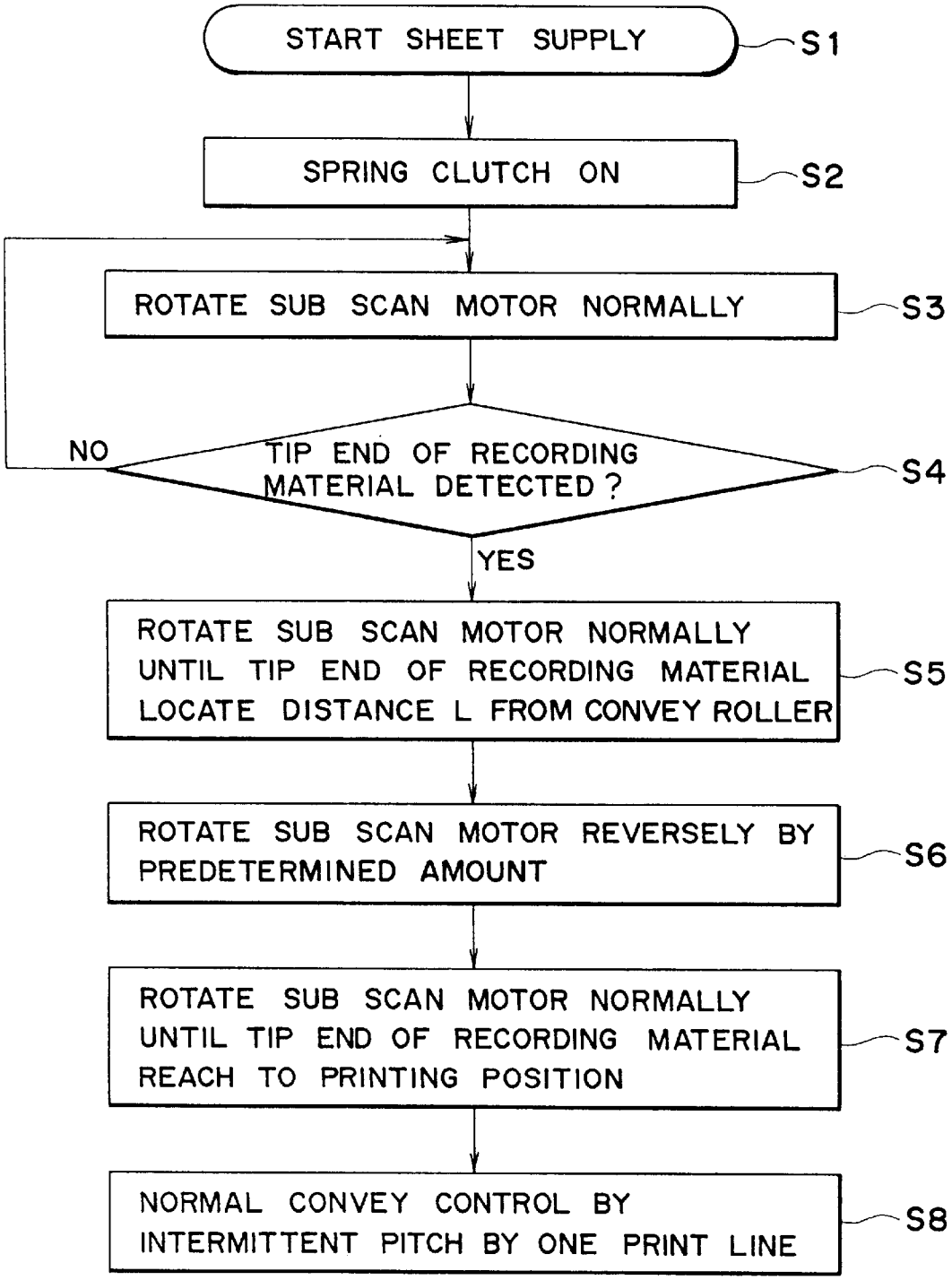
FIG. 12 is a flow chart for the sheet supplying operation.

The reverse rotation of the motor 24 is effected by sending to it a number of reverse driving pulses sufficient to feed back the leading end of the sheet projecting from the nip N of the rollers 6, 7 by the predetermined distance L in the reverse direction by the predetermined distance L or more (steps S5 and S6 in the flow chart in FIG. 12). By the reverse shifting of the sheet, the skew-feed of the sheet is prevented (corrected). This correction will be explained with reference to FIGS. 13 to 15.

Figure 13:
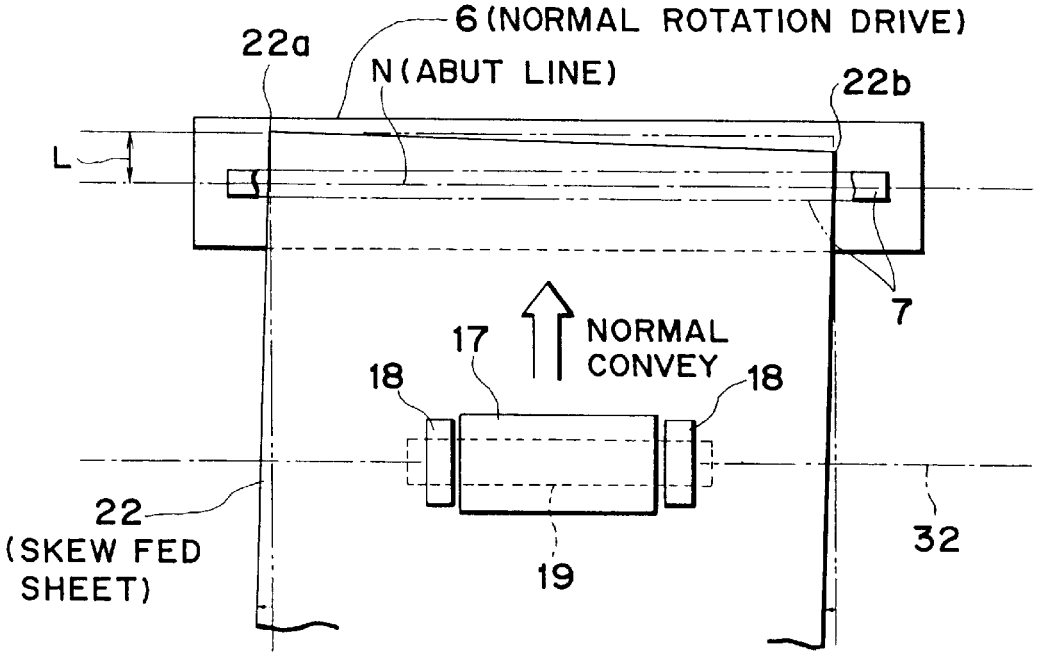
FIGS. 13 to 16 are plan views for explaining a skew feed preventing operation.

(1) FIG. 13 is a plan view showing the sheet in a condition corresponding to that shown in FIG. 9. In this condition, the leading end of the normally fed sheet 22 has passed smoothly through the nip N between the convey roller 6 and the driven roller 7 (second sheet feeding means) and been protruded by the predetermined distance L, and the convey roller 6 has just been switched from its normal rotation to reverse rotation.

This condition shows the fact that the sheet 22 has been skew-fed from the sheet supply roller 17 to the nip between the convey roller 6 and the driven roller 7. Since the sheet 22 was skew-fed, one corner 22*a* of the leading end of the sheet was protruded from the nip N of the rollers 6, 7 forwardly more than the other corner 22*b* of the sheet.

(2) From this condition, the sheet 22 is shifted in the reverse direction by the reverse rotation of the convey roller 6. In this case, since the friction force F2 for the sheet 22 due to the urging force between the sheet supply roller 17 and the friction member 19 is smaller than the friction force F1 for the sheet 22 due to the urging force between the convey roller 6 and the driven roller 7, the sheet 22 is shifted in the reverse direction while slipping between the sheet supply roller 17 and the friction member 19 without forming the loop in the sheet between the sheet supply roller 17/friction member 19 and the convey roller 6/driven roller 7. By the reverse shifting of the sheet, the other corner 22*b* of the leading end of the skew-fed sheet 22 firstly leaves the nip N of the rollers 6, 7. As soon as the other corner 22*b* has passed through the nip N, the corner 22*b* is not subjected to the reverse feeding force from the rollers 6, 7.

Figure 14:
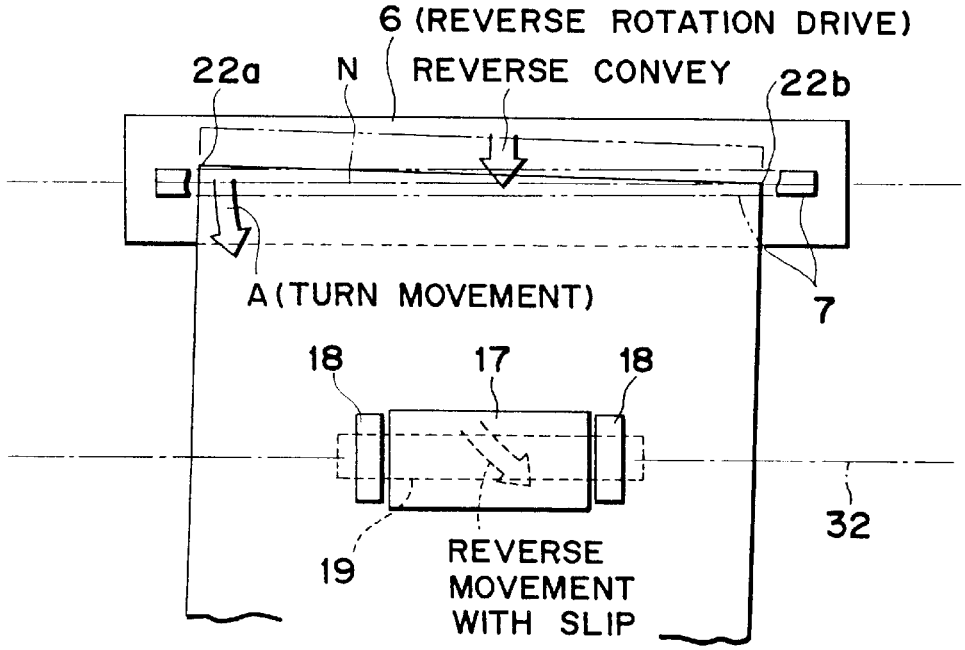

However, in this point, since the one corner 22*a* of the leading end of the sheet is still being shifted reversely between the nip N of the rollers 6, 7, the reversely shifted sheet 22 is turned in an anti-clockwise direction A around the other corner 22*b* of the leading end of the sheet which is abutted against the nip line between the rollers 6, 7 as shown in FIG. 14 until the one corner 22*a* of the leading end of the sheet passes through the nip N of the rollers 6, 7 not to be subjected to the reverse feeding force of the rollers.

Figure 15:
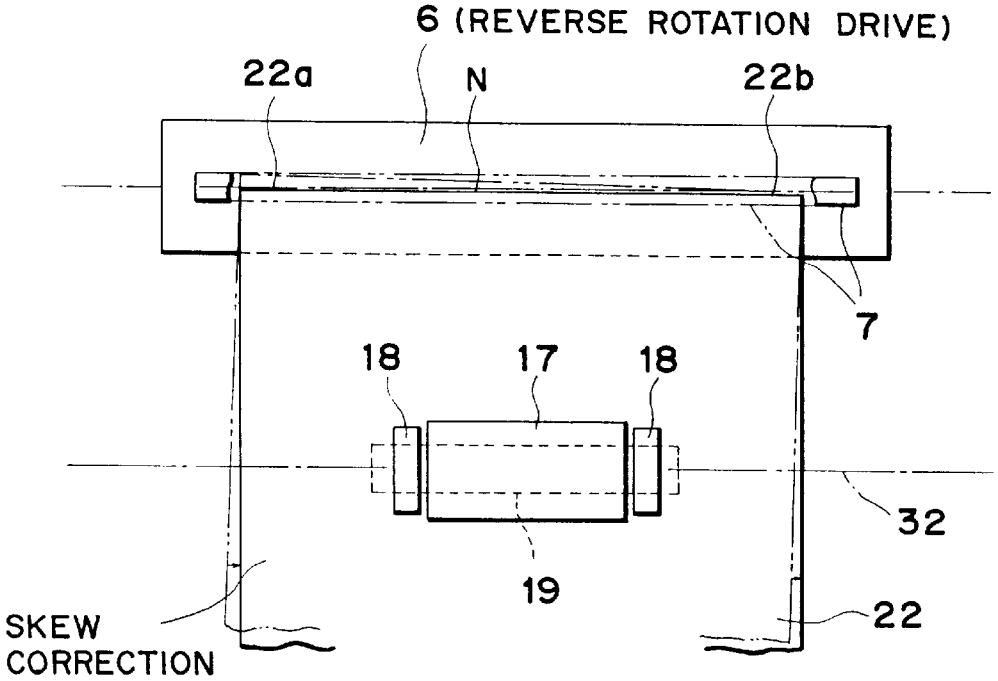

(3) When the turning movement of the sheet is finished by passing-the one end 22*a* of the leading end of the sheet through the nip N, as shown in FIG. 15 (corresponding to FIG. 10), the posture of the sheet 22 is corrected so that the whole length of the leading edge of the sheet is abutted against the nip line N of the rollers 6, 7 in parallel therewith, thus eliminating the skew-feed of the sheet.

Figure 11:
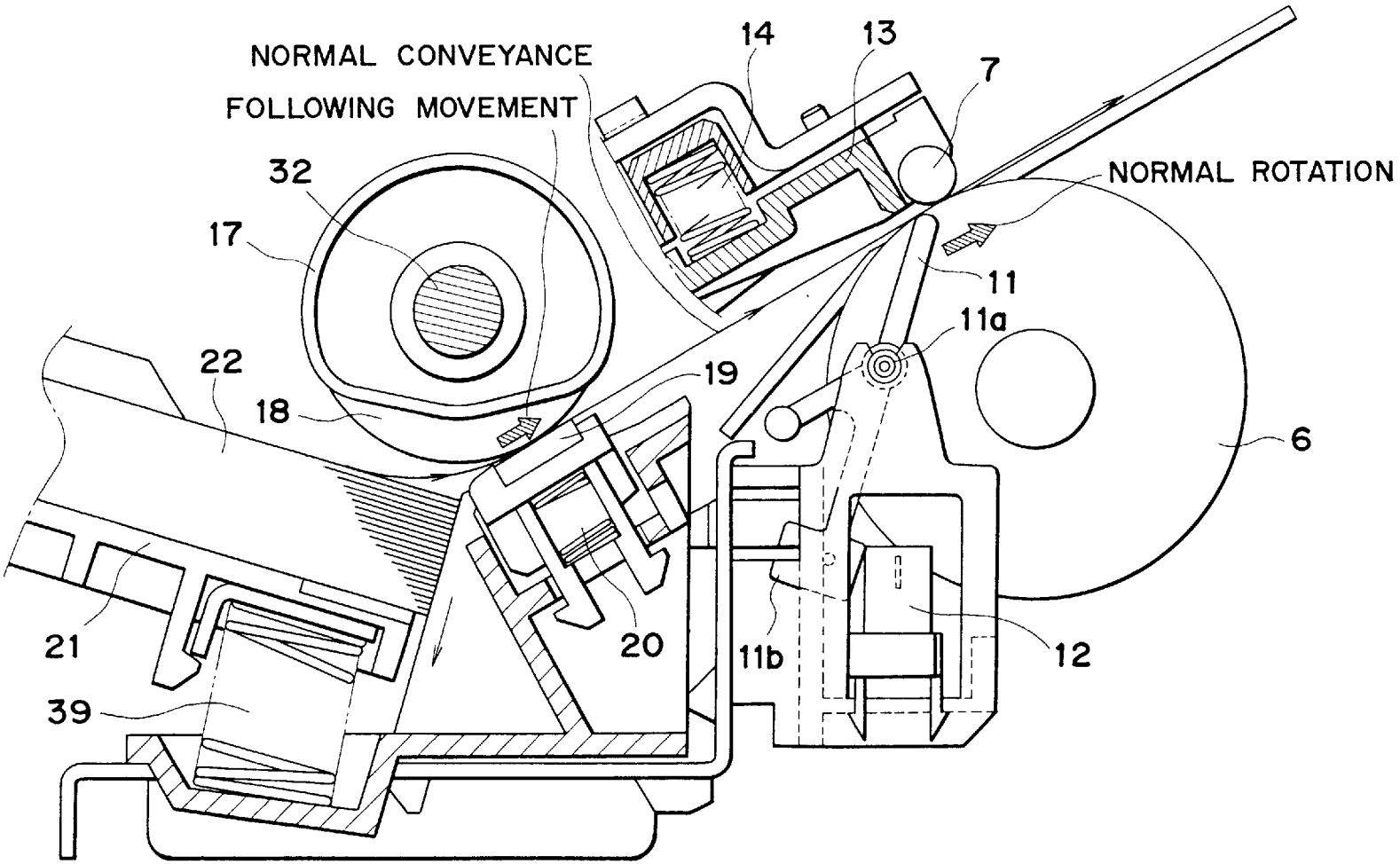
Figure 16:
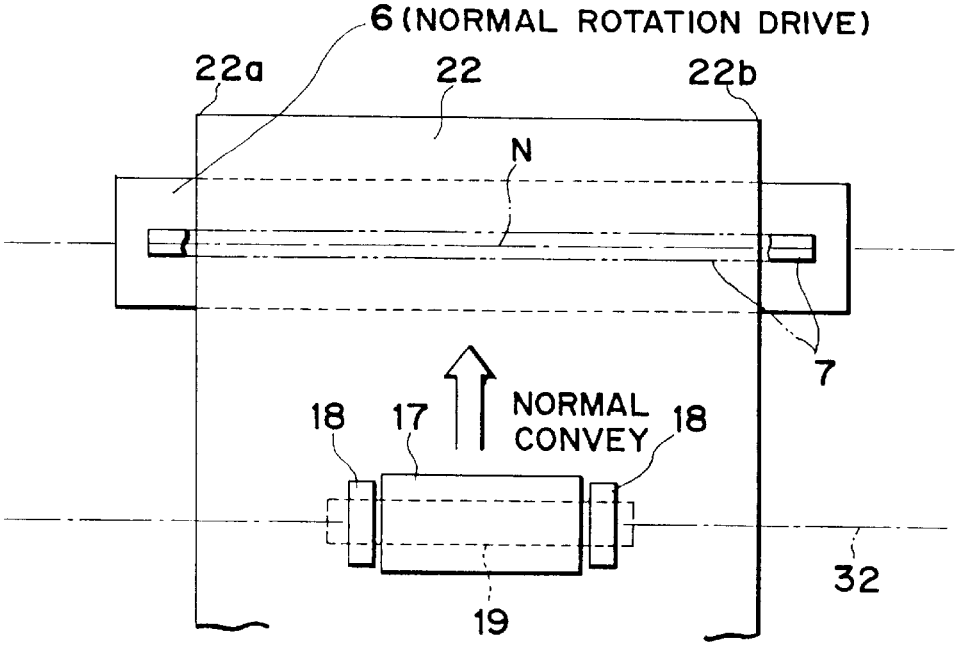

(g) As mentioned above, when the skew-feed of the sheet is corrected by rotating the convey roller 6 reversely by the amount corresponding to the predetermined number of pulses, the motor 24 is rotated normally again. When the motor 24 is rotated normally again, the convey roller 6 is rotated in the normal direction to enter the leading end of the sheet 22 into the nip N of the rollers 6, 7 in parallel therewith again, with the result that the sheet 22 is fed normally to a printing station 1, 10 as the sheet processing station without the skew-feed of the sheet (FIG. 11 and FIG. 16).

The normal rotation of the motor 24 causes the sheet supply roller gear 31 to rotate normally, thereby rotating the sheet supply roller 17 in the normal direction. In this case, when the sheet supply roller is rotated by a certain angle, the cylindrical portion of the sheet supply roller passes through the friction member 19 to separate from the sheet 22. From this point, the sheet 22 is pinched between the idle rollers 18 and the friction member 19, and the idle rollers 18 are rotatingly driven by the normal movement of the sheet 22.

Then, when the sheet supply roller 17 is rotated by one revolution, it is stopped since the lock lever 35A of the spring clutch 40 is engaged by the stopper 41 again to turn the clutch OFF. Even when the sheet supply roller 17 is stopped, the sheet 22 continues to be shifted normally by the normal rotation of the convey roller 6, and the idle rollers 18 are rotatingly driven until the trailing end of the sheet 22 leaves these rollers.

In the illustrated embodiment, since the recording system is of serial type, the normal re-feeding of the sheet due to the normal re-rotation of the motor 24 is effected until the leading end of the sheet reaches a predetermined printing position. At this point, the re-feeding of the sheet is temporarily stopped (step S7 in the flow chart in FIG. 12).

(h) Thereafter, the sheet is fed to the printing station 1, 10 under the normal convey control by an intermittent pitch by one print line (step S8 in the flow chart in FIG. 12). As a result, the image segments are successively recorded on the sheet 22 by the recording head 1 in the serial manner.

(i) The sheet passed through the printing station 1, 10 is ejected onto the ejection stacker 23 (FIG. 1) by the ejector rollers 8, 9. When the trailing end of the sheet 22 leaves the sensor lever 11, the latter is cocked again, whereby the light path of the photosensor 12 is blocked by the flag 11*b*, thereby detecting the passing of the trailing end of the sheet. The detection signal is inputted to the control means.

(j) After the printing is effected on the first sheet 22 and the latter is ejected onto the ejection stacker 23, the control and operation from the above (a)–(i) are repeated to process second, third and other sheets.

In the illustrated embodiment, while an example that the sheet 22 is pinched between the sheet supply roller 17 and the friction member 19 when the convey roller 6 is rotated reversely was explained, the present invention is not limited to this example, but the sheet may be pinched between the idle rollers 18 and the friction member 19. Further, another member may be provided to urge the reversely fed sheet to afford the frictional resistance to the sheet.

Figure 17:
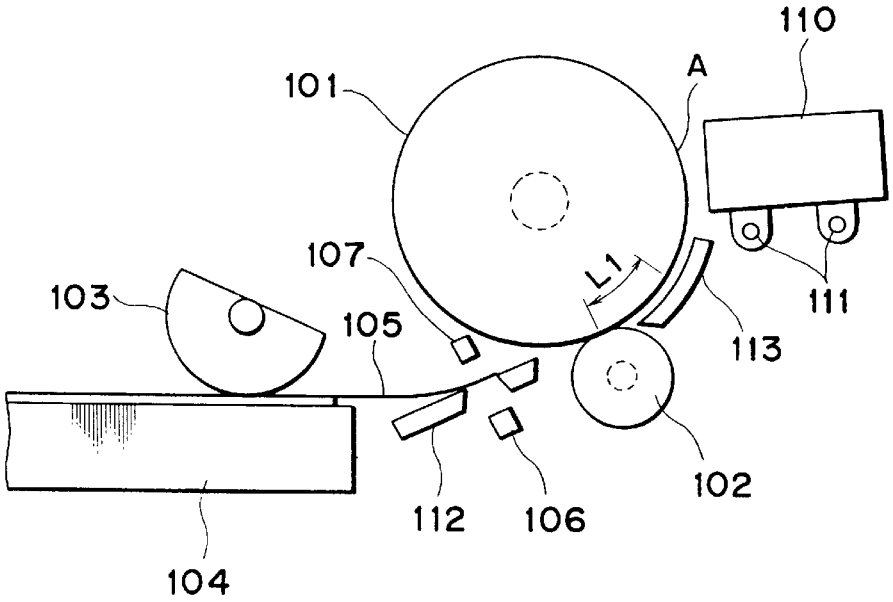
FIG. 17 is a schematic elevational sectional view of a sheet feeding apparatus according to an embodiment of the present invention.

FIG. 17 shows another embodiment of the present invention. In this embodiment, the reference numeral 101 denotes a convey roller (platen) for holding a recording medium (sheet) in a recording position and for feeding the recording sheet in a sub scanning direction; 102 denotes a driven roller for urging the recording sheet against the convey roller 101 to generate a feeding force; 103 denotes a sheet supply roller; 104 denotes a sheet stacker on which the recording sheets are stacked; 105 denotes the recording sheet; 106 denotes a recording sheet sensor such as a photosensor of reflection type for detecting the presence/absence of the recording sheet; and 107 denotes a recording sheet thickness sensor such as a supersonic sensor for detecting a thickness of the recording sheet.

When a sheet supplying operation is started by a sheet supply start signal, the convey roller 101 and the sheet supply roller 103 are rotated normally, thus picking up the recording sheet 105 on the sheet stacker 104 by the sheet supply roller 103. At the same time when a leading end of the sheet is detected by the recording sheet sensor 106, a thickness of the sheet is read by the recording sheet thickness sensor 107. Since a thickness of a cut sheet is in the order of 0.1 mm and a thickness of an envelope is in the order of 0.5 mm or more, these can easily be discriminated. If the kind of the sheet is discriminated as the cut sheet, the skew preventing control similar to the conventional one is effected. To the contrary, if the kind of the sheet is discriminated as the thicker sheet such as the envelope, the convey roller 101 and the sheet supply roller 103 continue to be rotated in the normal direction by a predetermined amount, thereby feeding the leading end of the sheet 105 to a predetermined print start position A.

The convey roller 101 also acts as a platen. In this embodiment, a recording head 110 is of bubble jet type wherein ink droplets are discharged by utilizing energy generated by evaporating the ink by thermal energy. The recording head 110 is guided by guides 111 so that the recording head 110 can be moved in a direction transverse to the sheet feeding direction. Incidentally, the reference numerals 112, 113 denotes sheet guides.

Figure 18:
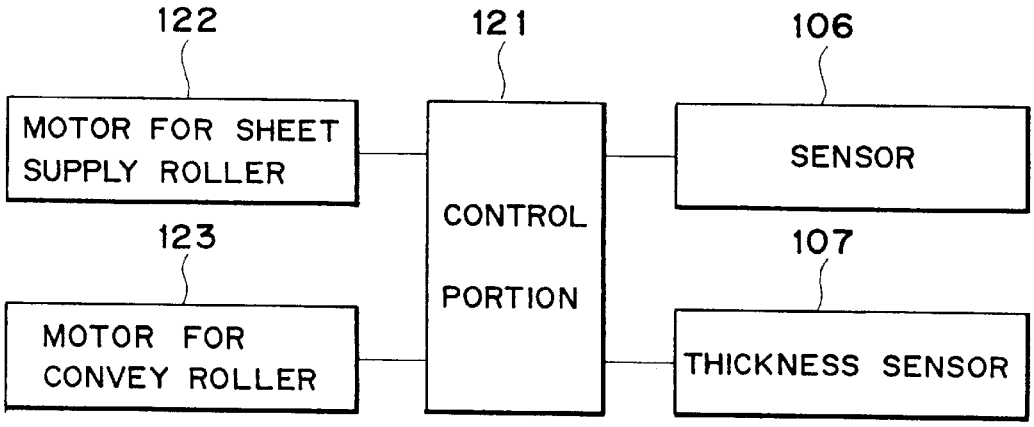
FIG. 18 is a control block diagram for the sheet feeding apparatus.

FIG. 18 shows a control block diagram. The reference numeral 121 denotes a control portion for controlling the feeding of the sheet; 122 denotes a motor for driving the sheet supply roller; and 123 denotes a motor for driving the convey roller 101.

Figure 19:
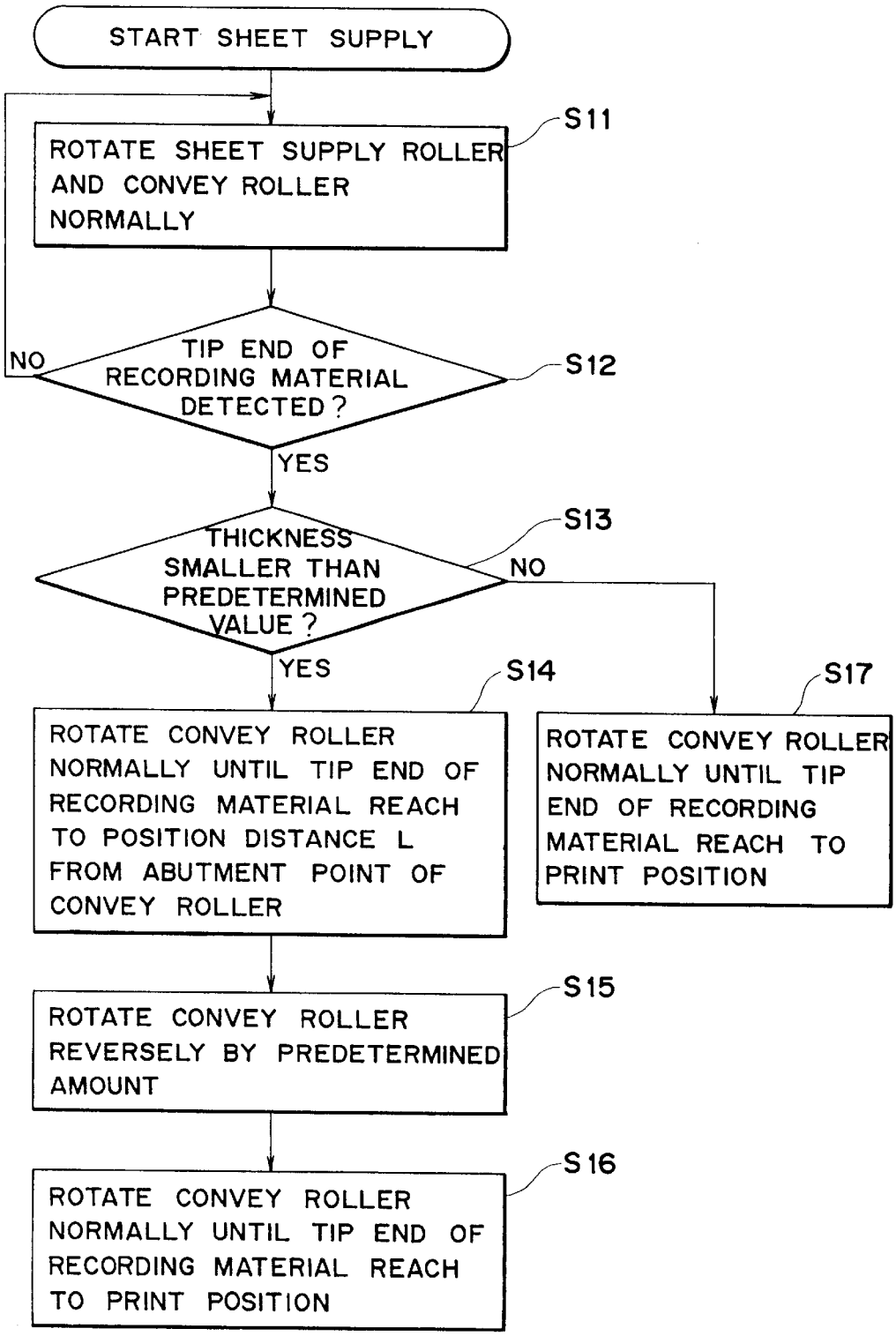
FIG. 19 is a flow chart for operating the sheet feeding apparatus.

Next, an operation of the recording system according to this embodiment will be explained with reference to a flow chart shown in FIG. 19.

When the sheet supply start signal is emitted, in a step S11, the motors 122, 123 are activated to rotate the sheet supply roller 103 and the convey roller 101 in a clockwise direction in FIG. 17. In a step S12, the leading end of the sheet is detected by the sensor 106 and the thickness of the sheet is detected by the thickness sensor 107. The thickness sensor 107 measures a distance between it and a surface of the sheet by utilizing the supersonic wave. And, if the distance is smaller than a predetermined value, it is judged that the sheet is the thicker sheet.

In case where the thickness of the sheet is below the predetermined value (i.e., cut sheet), the sheet is fed in the normal direction until the leading end of the sheet exceeds the nip (abutment point) between the paired rollers 101, 102 by a distance L1 toward a downstream side of the sheet feeding direction (step S14), and then the sheet supply roller 103 and the convey roller 101 are stopped. Then, the convey roller 101 is rotated reversely (anti-clockwise direction) by a predetermined amount sufficient to return the sheet in the reverse direction by a distance more than the distance L1, thereby drawing the leading end of the sheet out of the nip (step S15). As a result, a loop is formed in the sheet between the paired convey rollers 101, 102 and the sheet supply roller 103 while abutting the leading end of the sheet against the nip of the rollers 101, 102. Then the convey roller 101 is rotated normally again until a portion of the sheet on which the image segment for the first line is to be printed reaches the recording position between the convey roller 101 and the recording head 110. Whenever the one-line printing is effected by the recording head 110, the sheet is line-spaced by a predetermined amount. After the printing operation is finished, the sheet is ejected out of the system. In the step S13, if the thickness of the sheet is greater than the predetermined value, the sheet continues to be fed to the recording position, where the printing is effected on the sheet.

In this way, since the thickness of the sheet is detected and the sheet supply mode is changed in accordance with the thickness of the sheet, it is possible to provide the accurate sheet supplying operation with minimum skew-feed of the sheet, regardless of the thickness of the sheet.

In the above embodiment, while the sheet supply mode was changed through the recording sheet thickness sensor, it is to be understood that, in place of the recording sheet thickness sensor, an operator may change the sheet supply mode through an operation panel of the recording system (alteration).

Figure 20:
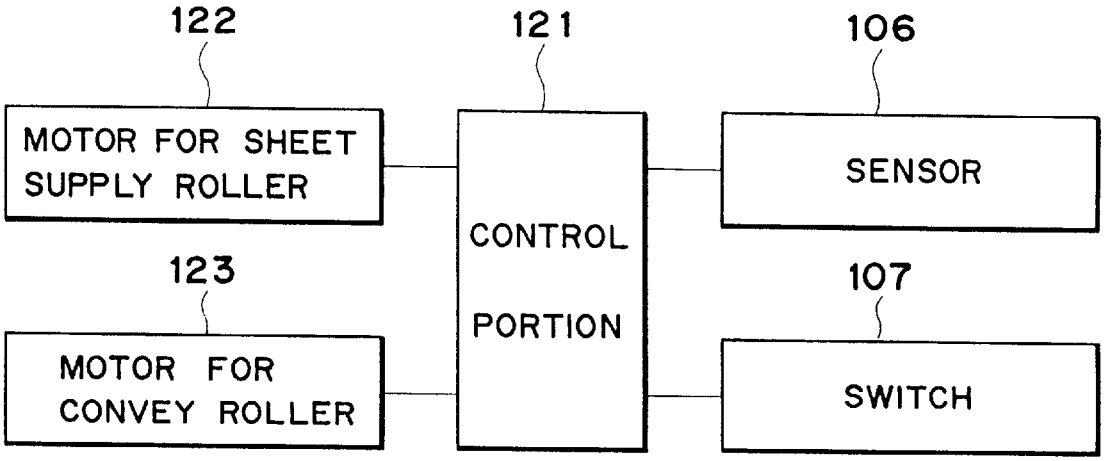
FIG. 20 is a control block diagram according to another embodiment.

Such alteration is shown in FIG. 20. This alteration differs from the embodiment of FIG. 18 in the point that a switch 107*a* is provided in place of the thickness sensor 107 and the operator can change the sheet supply mode between a plain paper mode and a thicker sheet mode via the switch. When the plain paper mode is selected via the switch 107*a*, after the step S12, the control sequences of the steps S14–S16 are effected; whereas, when the thicker sheet mode is selected, the control sequence of the step S17 is effected.

Figure 21:
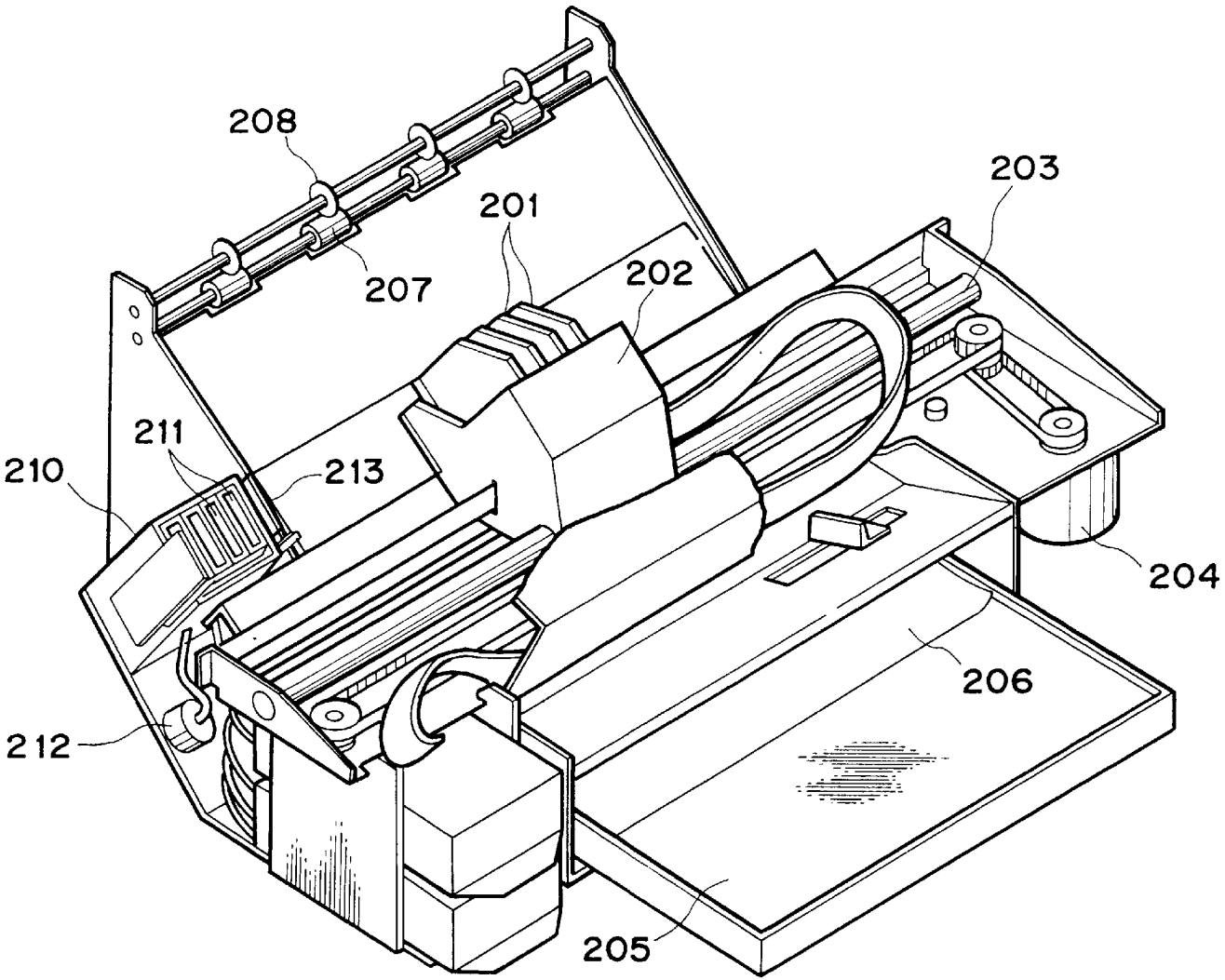
FIG. 21 is a schematic perspective view of an ink jet recording system as an example of a recording system to which the present invention is applied.

Next, a further embodiment of the present invention will be explained. FIG. 21 is a schematic perspective view of a recording system according to the further embodiment of the present invention. As an example, the recording system of ink jet type is shown.

In FIG. 21, the reference numeral 201 denotes a recording head as a recording means; 202 denotes a reciprocable carriage which can be shifted along the recording sheet and on which the recording head 201 is mounted; 203 denotes a guide rail for supporting and guiding the carriage 202; 204 denotes a carriage motor for shifting (main scan) the carriage via a transmission mechanism comprising belts and pulleys.

The recording means 201 shown in FIG. 21 is a recording means for the color recording, which comprises four recording heads for different recording colors mounted on the carriage 202. Such recording colors (ink colors) are, for example, black, cyan, yellow and magenta. Incidentally, hereinbelow, all of the four recording heads constituting the recording means or any one of these recording heads is referred as the recording means 201 or recording head 201.

Recording sheets 206 stacked in a sheet supply cassette 205 are supplied one by one by means of a sheet supply mechanism (not shown). The supplied recording sheet 206 is fed through a recording station by means of a feed mechanism (sub scanning means) and then is ejected out of the recording system by means of an ejector roller 207 and its associated driven roller 208. In the illustrated embodiment, the recording sheet 206 is passed below the recording head 201 and the carriage 202. The feed mechanism will be described later. In this way, there is provided a recording system (ink jet recording system) of serial type wherein the recording means (recording head) 201 is moved in the main scanning direction and the recording sheet 206 is moved in the sub scanning direction, thereby performing the recording.

The recording head 201 is an ink jet recording head wherein ink is discharged by utilizing thermal energy and which has electrical/thermal converters for generating the thermal energy. Further, the recording head 201 is so designed that the ink is discharged from discharge opening (s) by the pressure change generated by the growth and contraction of bubble(s) caused by the film boiling effected by the thermal energy applied to the electrical/thermal converter(s), thereby performing the recording.

Figure 22:
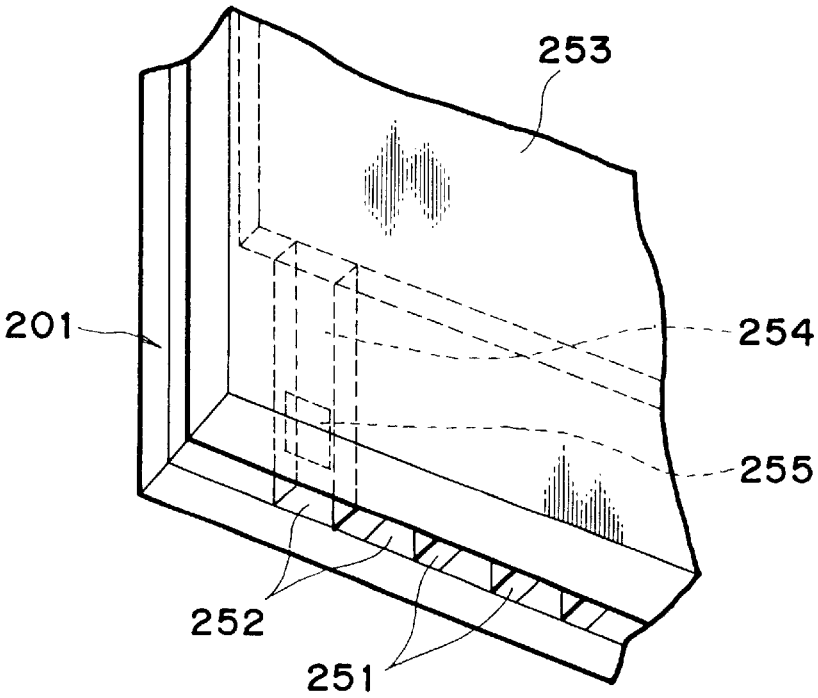
FIG. 22 is a partial perspective view of an ink discharge portion of a recording head of the recording system of FIG. 21.

FIG. 22 is a schematic perspective view showing the construction of the ink discharge portion of the recording head 201.

In FIG. 22, a plurality of discharge openings 252 are formed at a predetermined pitch in a discharge opening forming surface 251 disposed in confronting relation to the recording sheet 206 with a predetermined gap therebetween (for example, about 0.5–2.0 mm). A plurality of electrical/thermal converters (such as heat generating resistors) 255 for generating ink discharging energy are arranged along walls of respective liquid passages 254 communicating the respective discharge openings 252 with a common liquid chamber 253. In this embodiment, the recording head 201 is mounted on the carriage 202 so that the discharge openings 252 are lined up along a direction transverse to a scanning direction of the carriage 202. In this way, the recording head 201 is so designed that, on the basis of image signal or discharge signal, the corresponding electrical/thermal converter(s) are driven (energized) to generate the film boiling of the ink in the corresponding liquid passage(s) 254, whereby the ink is discharged from the corresponding discharge openings(s) 252 by the pressure caused by the film boiling. Such a recording head is applied to all of the embodiments as mentioned above.

In FIG. 21, a recovery device 210 for recovering the ink discharging condition of the recording head 201 is arranged within a shifting range of the carriage 202 and out of the recording zone. The recovery device 210 comprises caps 211 for closing or sealing the discharge openings 252 of the recording heads 201, a suction pump 212 for generating the negative pressure in each cap 211 to suck out the ink and other foreign matters from the discharge openings 252 and the like. Further, a wiping member 213 is disposed adjacent to the recovery device 210 to remove the ink droplets or other foreign matters such as paper powder and the like.

Figure 23:
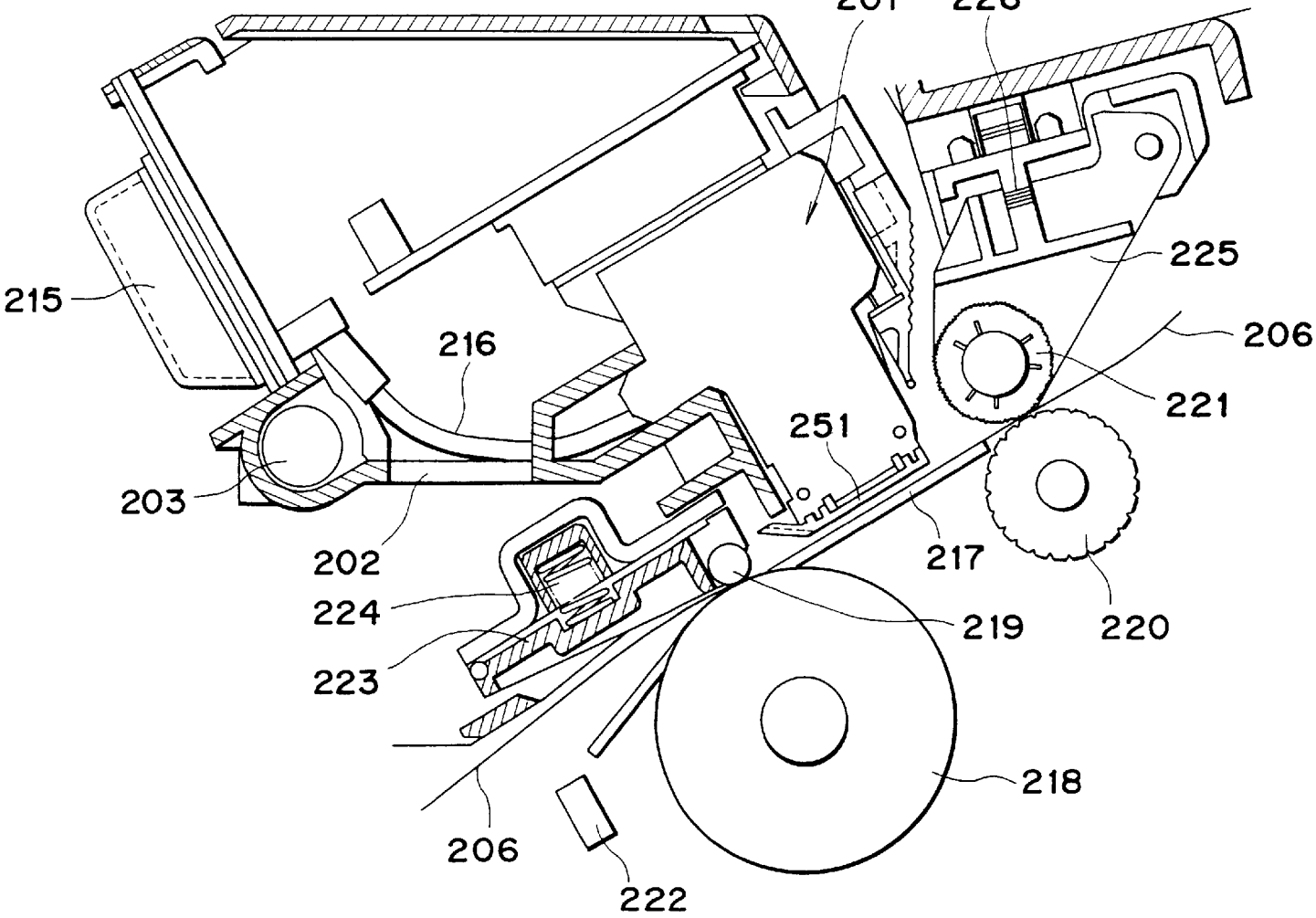
FIG. 23 is an elevational sectional view of a recording sheet feeding means and a recording portion of a recording system to which the present invention is applied.

FIG. 23 is an elevational sectional view of the recording system of FIG. 21 along the sheet feeding direction (sub scanning direction).

In FIG. 23, the reference numeral 201 denotes the ink jet recording head; 202 denotes the carriage which can be shifted in the main scanning direction for the recording operation and on which the recording head 201 is mounted; 203 denotes the guide rail (guide shaft) for guiding the main scan of the carriage 202; 215 denotes an ink tank for reserving ink discharged from the recording head 201; and 216 denotes an ink tube for supplying the ink from the ink tank 215 to the recording head 201.

In FIG. 23, a paper guide (platen) 217 for defining the recording position for the recording sheet 206 is arranged in confronting relation to the discharge opening forming surface 251 of the recording head 201. A first convey roller 218 for holding the recording sheet 206 and for feeding the recording sheet in the sheet feeding direction (sub scanning direction) is disposed at an upstream side of the paper guide 217 in the sub scanning direction. A first driven roller 219 associated with the first convey roller 217 is urged against the latter to pinch the recording sheet therebetween, thereby generating a feeding force. Further, a second convey roller 220 for holding the recording sheet 206 and for feeding the recording sheet in the sheet feeding direction (sub scanning direction) is disposed at a downstream side of the paper guide 217 in the sub scanning direction. A second driven roller 221 associated with the second convey roller 220 is urged against the latter to pinch the recording sheet therebetween, thereby generating a feeding force.

In FIG. 23, a recording sheet sensor 222 for detecting a leading-end and a trailing end of the recording sheet 206 is disposed at an upstream side of a nip (abutment point) between the first convey roller 218 and the first driven roller 219. This recording sheet sensor 222 may comprise a photosensor of reflection type or permeable type, for example. The first driven roller 219 is held by a first holder member 223 which is biased by a first spring 224 to urge the first driven roller 219 against the first convey roller 218. Further, the second driven roller 221 is held by a second holder member 225 which is biased by a second spring 226 to urge the second driven roller 221 against the second convey roller 220.

Normally, the first spring 224 is stronger than the second spring 226 so that the feeding force obtained by the abutment between the first convey roller 218 and the first driven roller 219 becomes greater than the feeding force obtained by the abutment between the second convey roller 220 and the second driven roller 221, with the result that a feeding amount (sub scanning amount) of the recording sheet 206 is accurately regulated or controlled by a rotational amount of the first convey roller 218.

Figure 24:
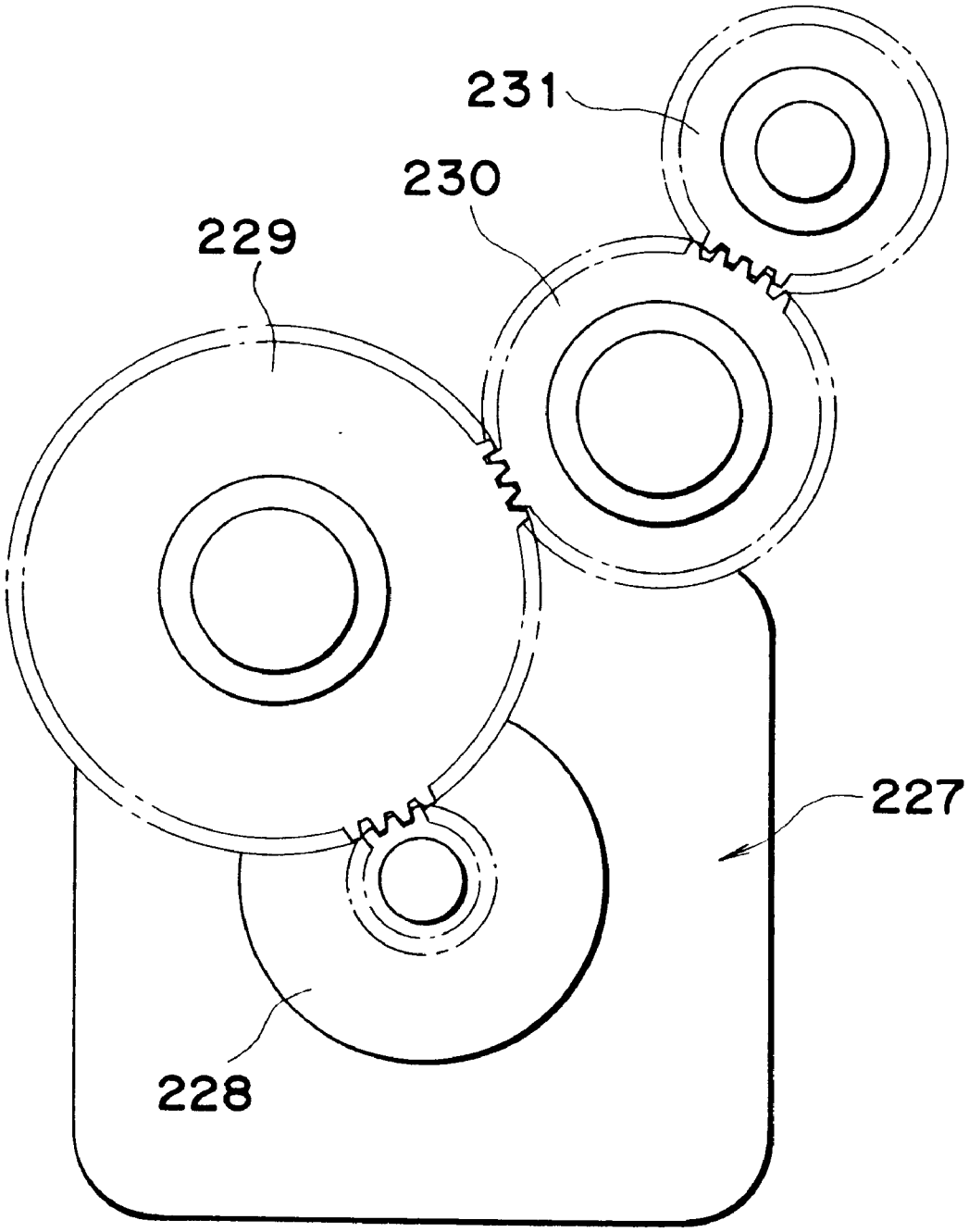
FIG. 24 is a schematic view showing a driving force transmitting mechanism of the recording sheet feeding means of FIG. 23.

FIG. 24 schematically shows a transmission mechanism for transmitting a driving force of a convey motor to the first and second convey rollers.

In FIG. 24, the reference numeral 227 denotes a convey motor (sub scanning motor) comprising a pulse motor and the like; 228 denotes a motor gear secured to a motor shaft of the convey motor 227; 229 denotes a first roller gear secured to a roller shaft of the first convey roller 218; 230 denotes an idle gear; and 231 denotes a second roller gear secured to a roller shaft of the second convey roller 220.

In the illustrated embodiment, the first and second convey rollers 218, 220 are driven the single motor (drive source) 227, thereby achieving decrease in the cost. Of course, the first and second convey rollers 218, 220 may be driven independently by respective motors. Further, a gear ratio and diameter of rollers in the transmission mechanism are so selected that a peripheral speed of the second convey roller 220 becomes faster than that of the first convey roller 218 by several percents in order to prevent the slack in the recording sheet 206 at the recording position between the first and second convey rollers 218, 220.

Figure 26A:
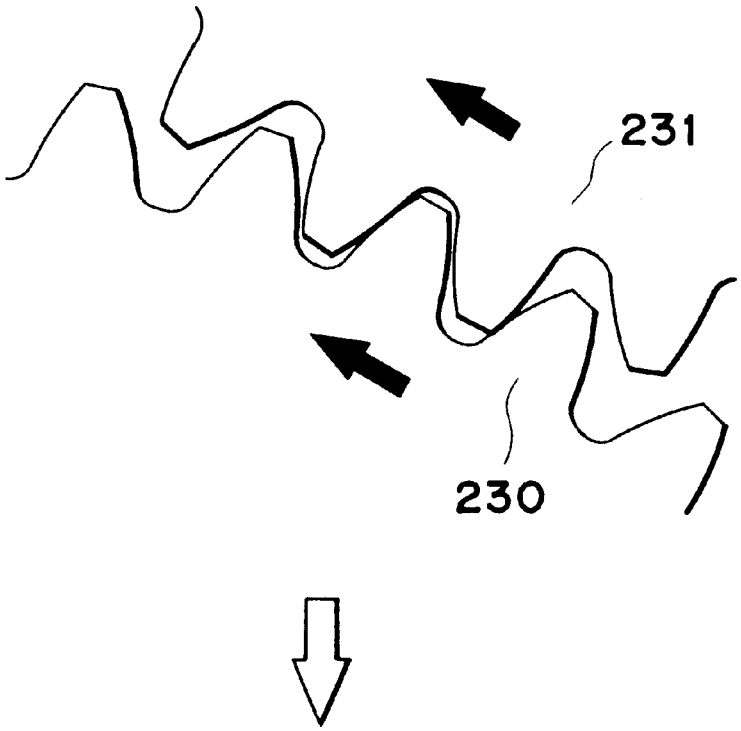
FIGS. 26A and 26B are schematic views for explaining the influence of the backlash in a gear train for driving the sheet feeding means of the recording system.
Figure 26B:
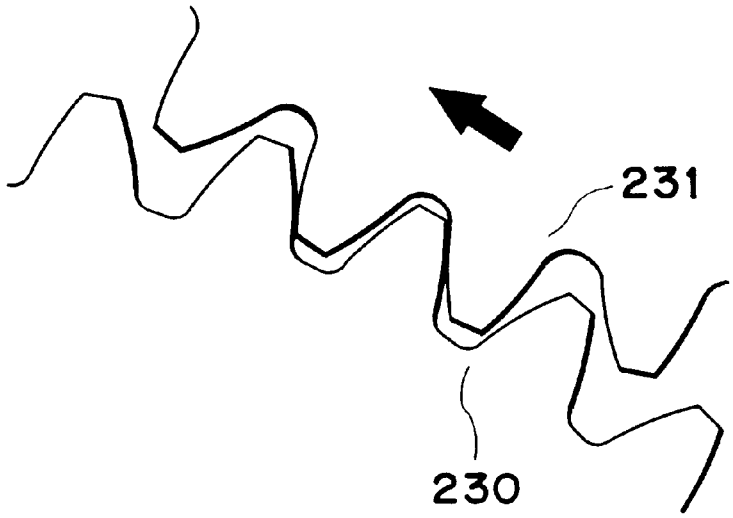
Figure 27:
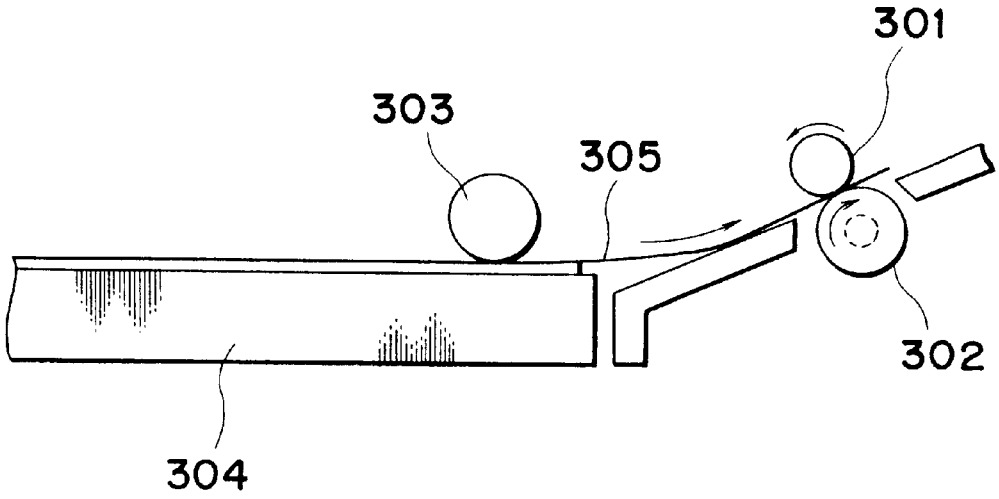
FIGS. 27 to 29 are partial sectional views of a conventional sheet feeding apparatus for explaining a sheet supplying operation.
Figure 28:
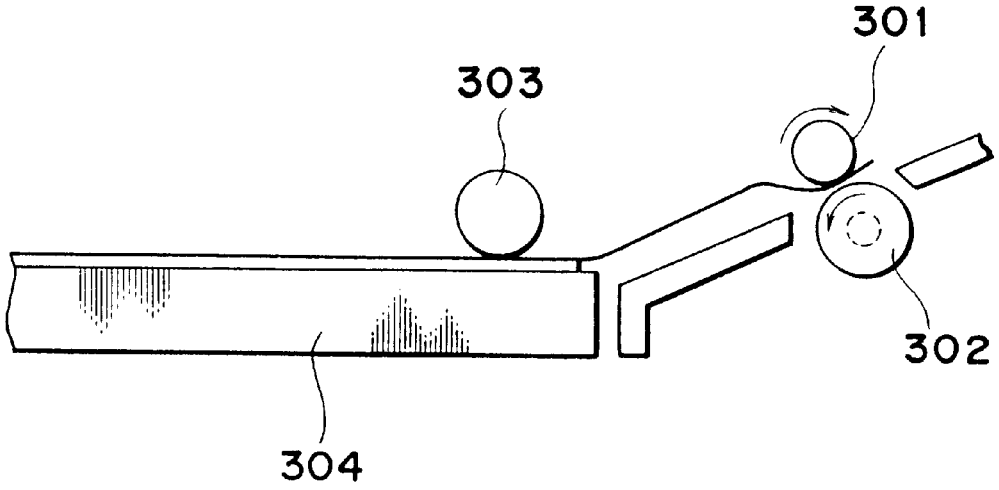
Figure 29:
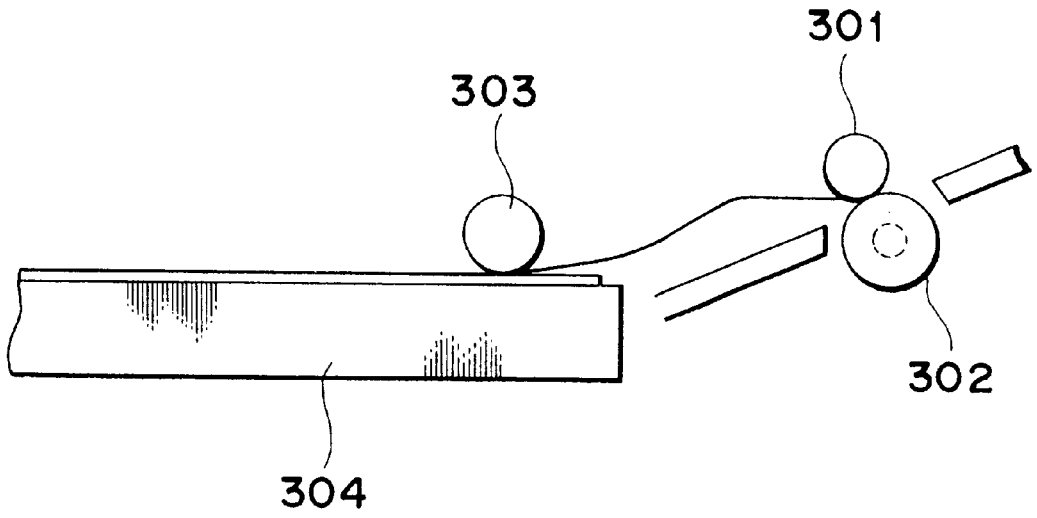
Figure 30:
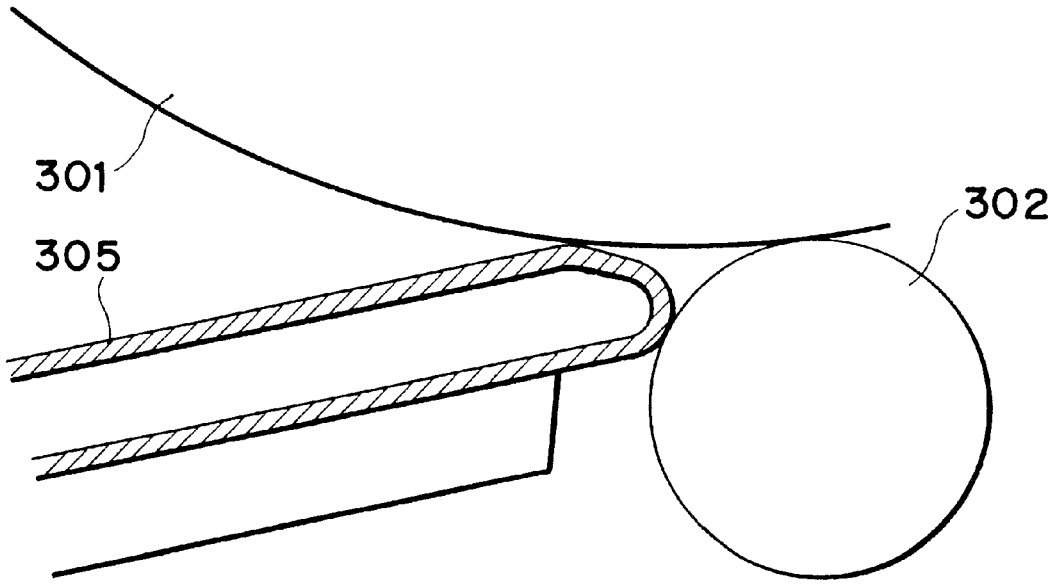
FIG. 30 is a partial sectional view of the conventional sheet feeding apparatus in a condition that an envelope is supplied.

FIGS. 26A and 26B are schematic views for explaining the influence of the backlash in transmission mechanism.

In FIGS. 26A and 26B, when a tension force pulling the second convey roller 220 toward the upstream side in the sheet feeding direction is temporarily disappeared, the backlash between the idle gear 230 and the second roller gear 231 is changed from a condition shown in FIG. 26A to a condition shown in FIG. 26B. The present invention aims to eliminate the influence of such backlash.

To achieve this, the recording system according to the present invention is so designed that, in feeding the recording sheet 206, a feeding speed of the first convey roller 218 becomes slower than the normal (usual) feeding speed within a predetermined range before and after the trailing end of the recording sheet 206 passes through the nip between the first convey roller 218 and the first driven roller 219.

Figure 25:
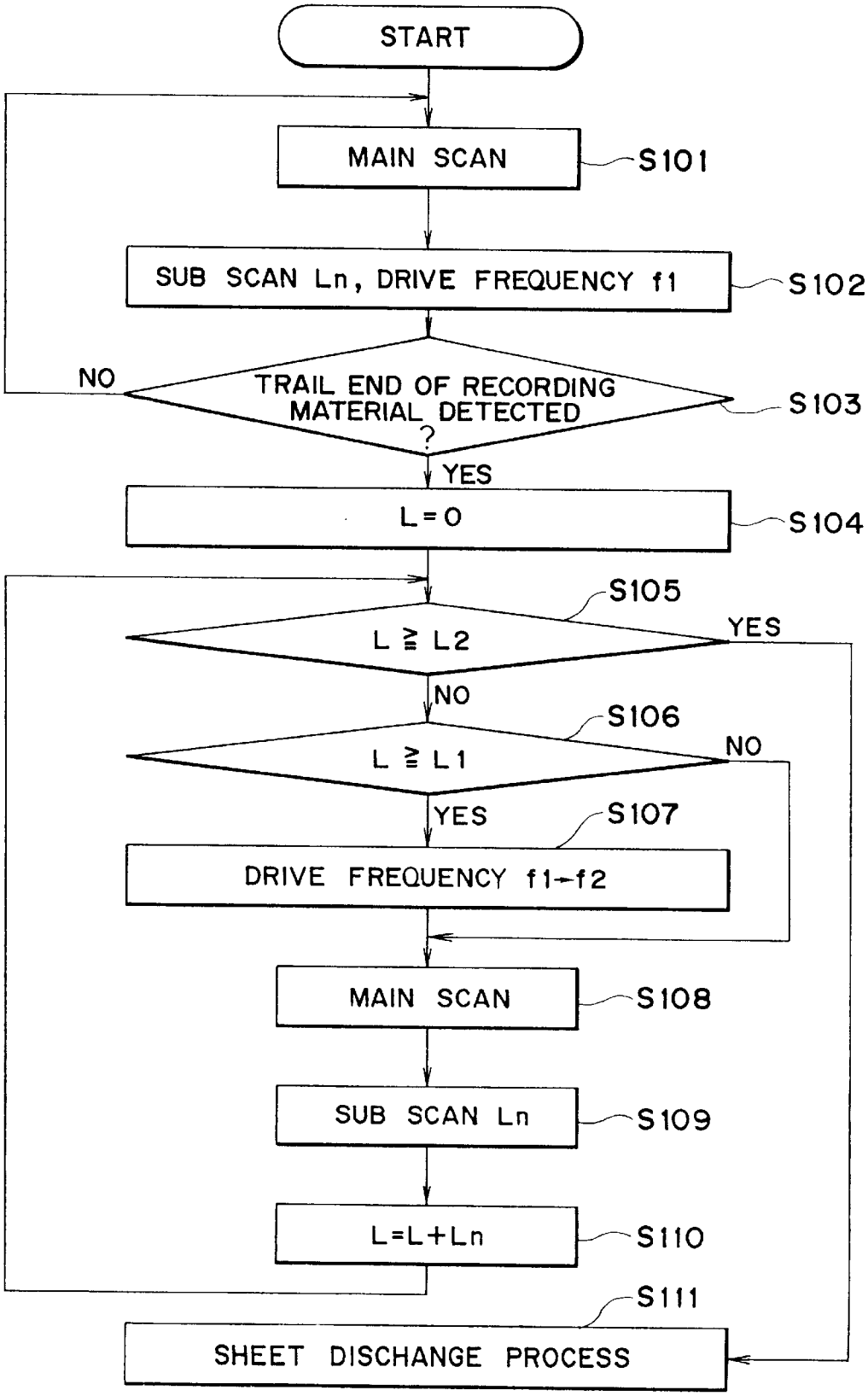
FIG. 25 is a flow chart showing a control sequence of a recording operation of a recording system to which the present invention is applied.

FIG. 25 is a flow chart showing the control sequence for the recording operation of the recording system in the illustrated embodiment.

In FIG. 25, when the recording operation is started, after the recording sheet 206 is set at the predetermined recording position, the recording is effected by discharging the ink from the recording head 201 onto the recording sheet 206 while shifting the carriage 202 in the main scanning direction (step S101). After the one-line recording is finished, the convey motor 227 is activated at a predetermined frequency f1 to rotate the first and second convey rollers 218, 220 by the predetermined amount, thus performing the sub scan (sheet feeding) by predetermined amount (for example, one line) Ln (step S102).

By repeating the above-mentioned main scan and the sub scan alternately, the recording is continued until the trailing end of the recording sheet 206 is detected by the recording sheet sensor 222. When the trailing end of the recording sheet 206 is detected by the recording sheet sensor 222 (step S103), the main scan and the sub scan Ln are repeated to perform the recording until the subsequent sum L of the sub scan amounts exceeds a predetermined amount L1 (L>L1) (steps S108 and S109). The sum L of the sub scan amounts is so selected that it corresponds to the feeding amount from when the trailing end of the recording sheet 206 was detected by the recording sheet sensor 222 to when the trailing end of the recording sheet 206 has just left the nip between the first convey roller 218 and the first driven roller 219. The sum L of the sub scan amounts exceeds the predetermined amount L1 (step S106), the driving frequency of the convey motor (pulse motor) 227 is changed from f1 to f2 (f1>f2), thus reducing the feeding speed (step S107).

The driving frequency f2 is so selected that, when the inertia moment of the second convey roller 220 is I and the moment due to the friction acting on the second convey roller 220 at its bearing portions is N, the angular velocity $\omega 2$ of the second convey roller 220 caused by the driving frequency f2 has a relation $N>I_{\omega}2$. After the driving frequency of the convey motor (sub scan motor) 227 is changed to f2, the main scan in the step S108 and the sub scan Ln in the step S109 are repeated to perform the recording until the sum L of the sub scan amounts after the trailing end of the recording sheet 206 was detected by the recording sheet sensor 222 exceeds a predetermined amount L2 (L>L2) (step S106 to step S110). When the sum L of the sub scan amounts exceeds the predetermined amount L2 (step S105), the recording sheet 20 is ejected or discharged (step S111).

According to the sub scan control explained in connection with FIG. 25, it is possible to set the feeding speed (sub scanning speed) of the recording sheet 206 to a value (frequency f2) slower than the normal speed (frequency f1) within the predetermined range before and after the trailing end of the recording sheet 206 passes through the nip between the first convey roller 218 and the first driven roller 219. Thus, it is possible to reduce the tension force pulling the second convey roller 220 toward the upstream side of the sheet feeding direction gradually (not temporarily), and, therefore, it is possible to eliminate the influence of the backlashes between the adjacent gears in the gear train (first roller gear 229, idle gear 230, second roller gear 231) of the transmission mechanism between the convey motor 227 and the first and second convey rollers 218, 220 (influence upon the sub scan). Accordingly, it is possible to prevent the distortion of the sub scan due to the backlash when the trailing end of the recording sheet 206 leaves the nip between the first convey roller and the first driven roller to thereby maintain the good sub scan through the whole recording zone and to prevent the recorded image quality from being worsened.

Incidentally, in the aforementioned embodiments, while the present invention was applied to the ink jet recording systems, the present invention can be applied to various recording systems such as wire dot recording systems, laser beam recording systems, thermal transfer recording systems and the like, as well as the ink jet recording systems, regardless of the types of the recording means (recording heads), with providing the same advantages. Further, in the aforementioned embodiments, while the recording system of serial type wherein the recording head(s) mounted on the carriage is shifted in the main scanning direction along the recording sheet was explained, the present invention can similarly be applied to recording systems of line type wherein the recording is effected by a recording means of line type through the whole or part of the recording width of the recording sheet, with providing the same advantages.

Further, in the aforementioned embodiments, while the color recording systems utilizing a plurality of recording heads for the different colors were explained, the present invention can be applied to a mono-color recording system utilizing a single head or a gradient color utilizing a plurality of recording heads for same color inks having different density, or the like, regardless of the number of recording heads, with providing the same advantages.

Furthermore, regarding the recording head, it may be formed integrally with an ink tank to constitute a cartridge or it may be formed independently from an ink tank and connected to the latter via an ink supply tube, regardless of the relation between the recording head and the ink tank, with providing the same advantages.

Incidentally, when the present invention is applied to the ink jet recording systems, it can be applied to an ink jet recording system having a recording head utilizing electrical/thermal converters such as piezo electric elements. Particularly, when the present invention is applied to an ink jet recording head having a recording means of the type wherein the ink is discharged by utilizing thermal energy, the excellent advantage can be expected, since it is possible to achieve the recording with high density and high resolving power.

It is preferable to employ the typical structure and the principle of structures disclosed in, for example, U.S. Pat. No. 4,723,129 and U.S. Pat. No. 4,740,796. This system can be adopted in a so-called "On-Demand" type and "Continuous" type structures. In this system, an electrothermal conversion member disposed to align to a sheet or a liquid passage in which liquid (ink) is held is supplied with at least one drive signal which corresponds to information to be recorded and which enables the temperature of the electrothermal conversion member to be raised higher than a nuclear boiling point, so that thermal energy is generated in the electrothermal conversion member and film boiling is caused to take place on the surface of the recording head which is heated. As a result, bubbles can be respectively formed in liquid (ink) in response to the drive signals. Due to the enlargement and contraction of the bubble, liquid (ink) is discharged through the discharge port, so that at least one droplet is formed. In a case where the aforesaid drive signal is made to be a pulse signal, a further satisfactory effect can be obtained in that the bubble can immediately and properly be enlarged/contract and liquid (ink) can be discharged while exhibiting excellent responsibility. It is preferable to employ a drive signal of the pulse signal type disclosed in U.S. Pat. No. 4,463,359 and U.S. Pat. No. 4,345,262. Furthermore, in a case where conditions for determining the temperature rise ratio on the aforesaid heated surface disclosed in U.S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electrothermal conversion member as disclosed in the aforesaid specifications, a structure disclosed in U.S. Pat. No. 4,558,333 and U.S. Pat. No. 4,459,600 in which the heated portion is disposed in a bent portion is included in the scope of the present invention. Furthermore, the present invention can effectively be embodied in a structure in which a common slit is made to be the discharge portion of a plurality of electrothermal conversion members and which is disclosed in Japanese Patent Laid-Open No. 59-123670 and a structure in which an opening for absorbing thermal energy pressure wave is formed to align to the discharge port and which is disclosed in Japanese Patent Laid-Open No. 59-138461. That is, the recording can be carried out effectively irrespective of embodiment of the recording head.

Further, the present invention can effectively be applied to a recording head of full-line type having a length corresponding to a maximum width of a recording sheet (recording medium) to be recorded. As such recording head, the construction wherein such length is attained by combining a plurality of recording heads or a single recording head integrally formed may be adopted. In addition, among the above-mentioned serial types, the present invention is effectively applicable to a recording head secured to the recording system, or to a removable recording head of chip type wherein, when mounted on the recording system, electrical connection between it and the recording system and the supply of ink from the recording system can be permitted, or to a recording head of cartridge type wherein an ink tank is integrally formed with the head.

Further, it is preferable that a head recovering means and an auxiliary aiding means are added to the recording head according to the present invention, since the effect of the present invention is further improved. More concretely, these means include a capping means for capping the recording head, cleaning means, pressurizing or suction means, and an auxiliary heating means comprising electrical/thermal converters or other heating elements or the combination thereof. Further, it is effective for the stable recording to perform an auxiliary discharge mode wherein the ink discharge regardless of the recording ink discharge is effected.

Further, as to the kind and number of the recording head to be mounted, each recording head may correspond to each different color ink, or a plurality of recording heads can be used for a plurality of inks having different colors and/or different density. That is to say, as the recording mode of the recording system, the present invention can effectively be applied not only to a recording mode with a single main color such as black, but also to a system providing a plurality of different colors and/or a full-color by mixing colors by using an integrated recording head or the combination of plural recording heads.

Further, in the illustrated embodiments, while the ink was liquid, the ink may be solid at a room temperature or less, or may be softened at a room temperature. In the above-mentioned ink jet recording system, since the temperature control is generally effected in a temperature range from 30° C. to 70° C. so that the viscosity of the ink is maintained within a stable discharging range, the ink may be liquidized when the record signal is emitted. In addition, ink having a feature that is firstly liquidized by the thermal energy, such as solid ink which serves to prevent the increase in temperature by absorbing energy in changing the ink from the solid state to the liquid state or which is in the solid state in the preserved condition to prevent the vaporization of ink and which is liquidized into ink liquid to be discharged in response to the record signal comprising the thermal energy, or ink which has already been solidified upon reaching the recording medium, can also be applied to the present invention.

In such a case, the ink can be held in the liquid state or solid state in recesses or holos in porous sheet as disclosed in the Japanese Patent Laid-Open Nos. 54-56847 and 60-71260, in confronting relation to the electrical/thermal converters. Incidentally, in the present invention, the above-mentioned film boiling principle is most effective for each ink. Furthermore, the ink jet recording system according to the present invention can be embodied as an image output terminal of an information processing equipment such as a computer, a copying machine combined with a reader and the like, a facsimile having the communication ability, or the like.

What is claimed is:

1. A sheet feeding method, comprising the steps of:

supplying a sheet from a sheet stack in a sheet feed direction with a sheet supply member nipping the sheet with a friction member in cooperation with the sheet supply member;

supplying the sheet in the sheet feed direction to a convey member with said sheet supply member, a distance between said sheet supply member and said convey member being smaller than the sheet length;

nipping the sheet with a nipping member in cooperation with said convey member; and conveying the sheet with said convey member in the sheet feed direction until a leading end of the sheet reaches a first predetermined distance in the sheet feed direction from said convey member;

conveying the sheet with said convey member in a direction opposite to the sheet feed direction by a second predetermined distance larger than the first predetermined distance, while the sheet is allowed to move between said sheet supply member and said friction member by slipping over said friction member without generating deformation with application of resistance by said sheet supply member and said sheet friction member; and conveying the sheet with said sheet supply member and said convey member in the sheet feed direction so that skew-feed of the sheet is corrected.

2. A sheet feeding method according to claim 1, wherein each of the convey member and the nipping member is a roller, and said method further comprises the step of urging said roller of the convey member and the roller of said nipping member against each other.

3. A sheet feeding method according to claim 2, wherein the sheet supply member is a roller, and the friction member is a friction pad cooperating with the roller to separate the sheet from other sheets.

4. A sheet feeding method according to claim 1, further comprising the step of driving the sheet supply member and the convey member by transmitting a driving force of a drive source to the sheet supply member and the convey member.

5. A sheet feeding method according to claim 4, wherein the driving step is performed by a motor.

6. A sheet feeding method according to claim 4, wherein (i) when the drive source is rotated in a first direction, the driving force is transmitted to the sheet supply member and the convey member to convey the sheet downstream, and (ii) when said drive source is rotated in a second direction opposite to the first direction, the driving force is transmitted to the convey member to convey the sheet upstream without transmitting the driving force to said sheet supply member.

7. A sheet feeding method according to claim 6, wherein the drive transmitting means is a spring clutch for not transmitting the driving force to the sheet supply means when the drive source is rotated in the second direction.

8. A sheet feeding method according to claim 1, wherein when a convey member is driven to convey the sheet upstream, a holding force of a sheet supply member when not driven and an urging force of a friction member to a sheet supply member are selected so that a convey force F1 acting onto the sheet by cooperation of a convey member and a nipping member is smaller than a resistance force F2 acting onto the sheet by cooperation of a sheet supply member and a friction member.

9. An image forming method comprising the steps of:

supplying a sheet from a sheet stack in a sheet feed direction with a sheet supply member;

nipping the sheet with a friction member in cooperation with the sheet supply member;

supplying the sheet in the sheet feed direction to a convey member with said sheet supply member, a distance between the sheet supply member and the convey member being smaller than the sheet length;

nipping the sheet with a nipping member in cooperation with said convey member;

conveying the sheet with said convey member in the sheet feed direction until a leading end of the sheet reaches a first predetermined distance in the sheet feed direction from said convey member;

conveying the sheet with said convey member in a direction opposite to the sheet feed direction by a second predetermined distance larger than the first predetermined distance, while the sheet is allowed to move between said sheet supply member and said friction member by slipping over said friction member without generating deformation with application of resistance by said sheet supply member and said sheet friction member;

conveying the sheet with said sheet supply member and said convey member in the sheet feed direction so that skew-feed of the sheet is corrected; and forming an image onto the sheet conveyed by the convey means.

10. An image forming method according to claim 9, wherein the image is formed by an ink jet recording head.

11. An image forming method according to claim 10, wherein the ink jet recording head generates an ink droplet by thermal energy.

12. A sheet feeding apparatus, comprising:

a support member for supporting a sheet stack;

a sheet supply member for supplying a sheet from the sheet stack in a sheet feed direction;

a friction member for nipping the sheet in cooperation with the sheet supply member;

a convey member located remote from said sheet supply member in the sheet feed direction by a distance smaller than a length of the sheet, for conveying the sheet in the sheet feed direction and in a direction opposite to the sheet feed direction; and a control device for controlling said sheet supply member and said convey member to convey the sheet in the sheet feed direction until a leading end of the sheet reaches a first predetermined distance in the sheet feed direction from said convey member, thereafter to convey the sheet in the direction opposite to the sheet feed direction by a second predetermined distance larger than the first predetermined distance, while the sheet is allowed to move between said sheet supply member and said friction member by slipping over said friction member without generating deformation with application of resistance by said sheet supply member and said sheet friction member, and thereafter to convey the sheet in the direction so that skew-feed of the sheet is corrected.

13. An image forming apparatus, comprising:

a support member for supporting a sheet stack;

a sheet supply member for supplying a sheet from the sheet stack in a sheet feed direction;

a friction member for nipping the sheet in cooperation with the sheet supply member;

a convey member located remote from said sheet supply member in the sheet feed direction by a distance smaller than a length of the sheet, for conveying the sheet in the sheet feed direction and in a direction opposite to the sheet feed direction;

a control device for controlling said sheet supply member and said convey member to convey the sheet in the sheet feed direction until a leading end of the sheet reaches a first predetermined distance in the sheet feed direction from said convey member, thereafter to convey the sheet in the direction opposite to the sheet feed direction by a second predetermined distance larger than the first predetermined distance, while the sheet is allowed to move between said sheet supply member and said friction member by slipping over said friction member without generating deformation with application of resistance by said sheet supply member and said sheet friction member, and thereafter to convey the sheet in the sheet feed direction so that skew-feed of the sheet is corrected; and an image forming device for forming an image onto the sheet conveyed by said convey member.

* * * * *

UNITED STATES PATENT AND TRADEMARK OFFICE

CERTIFICATE OF CORRECTION

PATENT NO. : 5,982,400

DATED : November 9, 1999

INVENTOR(S): KATSUYUKI YOKOI, ET AL.

It is certified that error appears in the above-identified patent and that said Letters Patent is hereby corrected as shown below:

COVER PAGE AT ITEM [56]

Foreign Patent Documents: "3101979" and "3177247" should read --3-101979-- and --3-177247--, respectively.

COLUMN 1:

Line 24, "means-comprises" should read --means comprises--

COLUMN 3:

Line 65, "is" should read --has--.

COLUMN 5:

Line 2, "convery" should read --convey--.

COLUMN 8:

Line 50, "rotating" should read --rotating in--; and

Line 64, "being" should read --while being--.

COLUMN 11:

Line 49, "denotes" should read --denote--.

COLUMN 15:

Line 1, "is" should read --has--.

UNITED STATES PATENT AND TRADEMARK OFFICE

CERTIFICATE OF CORRECTION

PATENT NO. : 5,982,400

DATED : November 9, 1999

INVENTOR(S): KATSUYUKI YOKOI, ET AL.

It is certified that error appears in the above-identified patent and that said Letters Patent is hereby corrected as shown below:

COLUMN 18:
Line 37, "member" should read --member;--.

COLUMN 20:
Line 30, "direction" should read --sheet-feed direction--.

Signed and Sealed this

Twelfth Day of September, 2000

*Attest:*

Q. TODD DICKINSON

*Attesting Officer*

*Director of Patents and Trademarks*